US006455794B2

(12) United States Patent
Sato et al.

(10) Patent No.: US 6,455,794 B2
(45) Date of Patent: Sep. 24, 2002

(54) KEY SWITCH DEVICE, KEYBOARD WITH THE KEY SWITCH DEVICE, AND ELECTRONIC APPARATUS WITH THE KEYBOARD

(75) Inventors: Hirofumi Sato, Gifu; Isao Mochizuki, Gifu-ken, both of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/748,376

(22) Filed: Dec. 27, 2000

(30) Foreign Application Priority Data

Jan. 7, 2000 (JP) ..... 2000-001709
Feb. 7, 2000 (JP) ..... 2000-028581
Mar. 31, 2000 (JP) ..... 2000-099148

(51) Int. Cl.[7] ..... H01H 13/70

(52) U.S. Cl. ..... 200/344; 200/5 A; 200/517; 400/490; 400/492

(58) Field of Search ..... 200/5 A, 517, 200/344, 345, 341; 400/490, 492, 495, 496

(56) References Cited

U.S. PATENT DOCUMENTS 5,813,521 A * 9/1998 Koike et al. ..... 200/344
5,874,696 A * 2/1999 Hayashi et al. ..... 200/345
6,011,227 A * 1/2000 Yoneyama ..... 200/344
6,060,676 A * 5/2000 Pan ..... 200/341
6,118,092 A * 9/2000 Hayashi ..... 200/344
6,133,538 A * 10/2000 Hsu ..... 200/341
6,137,071 A * 10/2000 Yeh et al. ..... 200/341

FOREIGN PATENT DOCUMENTS

| | | |
|---|---|---|
| JP | 05-342945 | 12/1993 |
| JP | 06-044860 | 2/1994 |
| JP | 09-190735 | 7/1997 |
| JP | 10-172380 | 6/1998 |
| JP | 11-003628 | 1/1999 |

* cited by examiner

*Primary Examiner*—Elvin Enad
*Assistant Examiner*—Kyung S. Lee
(74) *Attorney, Agent, or Firm*—Oliff & Berridge, PLC

(57) ABSTRACT

In a key switch device, a gear portion 31 of a first link member 12 is provided with an upper tooth portion 45 and a lower tooth portion 43 disposed in adjacent relation in a width direction of the first link member 12 and in upper-and-lower relation in a thickness direction of the same. Similarly, a gear portion 31 of a second link member 12 is provided with an upper tooth portion 45 and a lower tooth portion 43 disposed in adjacent relation in a width direction of the second link member 13 and in upper-and-lower relation in a thickness direction of the same. The upper and lower tooth portions 45 and 43 in the first link member 12, and, those in the second link member 13, are not provided in aligned and spaced relation in the thickness direction of the respective link members 12 and 13.

26 Claims, 20 Drawing Sheets

KEY SWITCH DEVICE, KEYBOARD WITH THE KEY SWITCH DEVICE, AND ELECTRONIC APPARATUS WITH THE KEYBOARD

BACKGROUND OF THE INVENTION

1. Field of the Invention

The present invention relates to a key switch device in which vertical and horizontal motions of a key top are guided and supported with a pair of link members which are operated synchronously when the key top is depressed with favorable operability; a keyboard provided with the key switch device; and an electronic apparatus provided with the keyboard; and particularly to a key switch device provided with link members including gear parts with improved structures for allowing synchronous action of the link members; a keyboard provided with the key switch device; and an electronic apparatus provided with the keyboard.

The present invention also relates to a key switch device in which a horizontal motion of a key top in course of depression is restrained to provide stable key operability, a keyboard provided with the key switch device, and an electronic apparatus provided with the keyboard.

Moreover, the present invention relates to a key switch device in which a guide member including a key top is removably mounted on a circuit board, a keyboard provided with the key switch device, and an electronic apparatus provided with the keyboard.

2. Description of Related Art

Conventionally, various types of key switch devices have been proposed. In association with the recent trend toward a thin key switch device, enhancement of key operability, etc., there has been proposed a key switch device in which a pair of link members support a key top for guiding vertical movement of the key top, and the link members are operated in synchronization with each other upon depression of the key top, thus achieving a reduction in thickness (height) of a key switch device and an enhanced key top operability.

For example, Japanese patent unexamined publication No. 11-003628 discloses a key switch device in which a pair of bearing portions each having two bearing holes are provided on the underside of a key top and a guide claw is provided at each end of two recesses formed on the upper surface of a support part. In this device, two support shafts of one gear link member are rotatably supported in the bearing holes, and also each end of a support shaft is slidably supported between the recess and the guide claw. Two support shafts of the other gear link member are rotatably supported in the bearing holes, and also each end of a support shaft is slidably supported between the recess and the guide claw.

In the above key switch device, a pair of middle shafts constituting each of the two gear link members is formed with gear portions having one tooth or two teeth at the upper ends. The tooth or teeth of each gear portion of the middle shaft of the gear link member engage the tooth or teeth of each gear portion of the middle shaft of the other gear link member. When the key top is depressed from a non-depression position (original position) through elasticity of a protrusion of an actuator provided on a rubber sheet, the support shafts of the gear link members are rotated in the bearing holes, while each of the support shafts is slid outwardly between the recess and the guide claw. At this time, the teeth of the gear portions of the gear link members are engaged with each other, thereby allowing synchronous operation of the link members.

The structure of the gear portion of each gear link member adopted in the key switch device in the abovementioned publication is explained below with reference to FIG. 26. FIG. 26 is a schematic perspective enlarged view of the gear portions of the gear link members in the conventional key switch device. In FIG. 26, a first gear link member 100 has a pair of middle shafts 101 and 102 on which support shafts 103 and 104 are provided protruding outwardly. The support shafts 103 and 104 are rotatably supported in the bearing holes of bearing portions provided on the underside of the key top.

Like the first gear link member 100, a second gear link member 105 has a pair of middle shafts 106 and 107 on which support shafts 108 and 109 are provided protruding outwards. The support shafts 108 and 109 are rotatably supported in the bearing holes of the other bearing portions provided on the underside of the key top.

A gear portion 110 is formed in the tip end of a middle shaft 101 of the first gear link member 100. This gear portion 110 is provided with a single gear tooth 111. A gear portion 112 is formed in the tip end of a middle shaft 102. This gear portion 112 is provided with double gear teeth 113.

A gear portion 114 is formed in the tip end of a middle shaft 106 of the second gear link member 105. This gear portion 114 is provided with double gear teeth 115. The gear tooth 111 of the gear portion 110 of the middle shaft 101 of the first gear link member 100 is engaged between the double gear teeth 115 of the gear portion 114 of the middle shaft 106. A gear portion 116 is formed in the tip end of a middle shaft 107 of the second gear link member 105. This gear portion 116 is provided with a single gear tooth 117. This gear tooth 117 is engaged between the double gear teeth 113 of the gear portion 112 of the middle shaft 102 of the first gear link member 100.

As above, the gear tooth 111 of the middle shaft 110 is engaged with the gear teeth 115 of the middle shaft 106, while the gear teeth 113 of the middle shaft 102 are engaged with the gear tooth 117 of the middle shaft 107. Thus, as the key top is depressed, the first and second gear link members 100 and 105 are synchronously operated, allowing downward movement of the key top with its horizontal condition maintained.

Meanwhile, an electronic apparatus such as notebook-size computers, mobile computer devices and the like have come into wide use rapidly. In association with this, a reduction in thickness of a keyboard associated with such the electronic apparatus has been promoted year after year. Accordingly, a key switch device is increasingly required to be reduced in thickness.

In the conventional key switch device mentioned above, however, the gear teeth 113 of the middle shaft 102 of the first gear link member 100 and the gear teeth 115 of the middle shaft 106 of the second gear link member 105 are formed in a double teeth configuration of an upper and lower teeth aligned and spaced in the thickness direction of the middle shaft 102 or 106. To help a further reduction in thickness or height of a key switch device, the gear teeth 113 and 115 have to be further reduced in thickness and size.

This makes it difficult to assemble the gear tooth 111 of the first gear link member 100 and the gear teeth 115 of the second gear link member 105, and the gear teeth 113 of the first gear link member 100 and the gear tooth 117 of the second gear link member 105 in a proper engagement relationship. As a result, an assembling efficiency of the key switch device would be deteriorated.

As mentioned above, the gear teeth 113 and 115 must be reduced in thickness and size to achieve a thinner key switch device, resulting in a decrease in durability of the gear teeth 113 and 115. Thus, a key switch device with high durability for long-term use could not be achieved.

In the case where the gear teeth 113 and 115 are made of a resin, each of which has a double teeth configuration; upper and lower teeth provided in aligned and spaced relation in the thickness direction of the middle shaft 102 or 106, the gear link member 100 (105) having such the gear teeth 113 (115) could not be molded by only a simple die constructed of upper and lower parts which are opened in the shaft thickness direction. In this case, a slide die which is removably arranged in parallel to the teeth is further needed to form the double teeth configuration. This slide die necessarily occupies space. Accordingly, the number of gear link members to be made with use of one die would be reduced. This decreases production efficiency of the gear link members.

Meanwhile, in the key switch device, when the key top is moved horizontally in a non-depression position or a depressed position, key operability becomes unstable and deteriorated. For preventing this, in most instances, restraints are put on the horizontal motion of the key top held in the non-depression or depressed position.

Furthermore, the horizontal motion of the key top in course of depression causes more serious problems in the key operability. In view of this point, restraints are also provided on the horizontal motion of the key top being in depression.

For instance, Japanese patent unexamined publication No. 6-44860 discloses a key switch device constructed as follows. An engagement bar of one of a pair of link members is slidably engaged in an engagement groove of an engagement portion provided on the underside of a key top. An engagement pin is slidably engaged in an engagement groove in an engagement portion of a holder member. An engagement pin of the other link member is slidably engaged in an engagement groove of an engagement portion provided on the underside of the key top. An engagement bar is slidably engaged in an engagement groove of an engagement portion of the holder member.

In this key switch device, upper and lower ends of each of the link members are slidably engaged in the corresponding engagement portions of the key top and the holder member. This key top may be moved horizontally in course of depression. Thus, a shaft provided on the outside of one of the link members is guided vertically in a shaft guide groove of a guide wall upright provided in the holder member in order to restrain the horizontal motion of the key top in depression.

Japanese patent unexamined publication No. 5-342945 discloses a key switch device constructed such that an upper end of one of a pair of link members is rotatably supported on the underside of a key top and a lower end of the same is slidably engaged in a holder member, and an upper end of the other link member is rotatably engaged on the underside of the key top and a lower end of the same is slidably engaged in the holder member. In this key switch device, as with the above device, the lower ends of the link members are slidably engaged in the holder member, which may cause the horizontal motion of the key top in depression. To restrain the motion of the key top in depression, a positioning pin of a positioning member provided in the holder member is guided to slide in a positioning groove of a positioning member provided extending downward from the underside of the key top.

The above key switch devices disclosed in the publications No. 6-44860 and No. 5-342945 can prevent the horizontal motion of the key top even in course of depression based on a cooperative action of the shaft of the link member and the shaft guide groove of the guide wall or a cooperative action of the positioning groove of the positioning member and the positioning pin.

In the key switch device disclosed in the publication No. 6-44860, however, the guide wall with the shaft guide groove needs to be formed in the holder member. This guide wall also needs a height corresponding to about half of the height of the key switch device. This presents a large obstacle to an attempt to reduce the height of the key switch device. Also, the structure of the holder member may become complicated, which causes an increase in cost for its manufacture.

In the key switch device disclosed in the publication No. 5-342945, it is also necessary to form the positioning member with the positioning groove and to form the positioning member with the positioning pin in the holder member. The positioning members have to be formed with a height about half of that of the key switch device. Therefore, as in the case of the above key switch device, there occurs a large obstacle to materialization of a thinner key switch device. The structure of the holder member may also become complicated, causing an increased cost for its manufacture.

Furthermore, there has been proposed a key switch device constructed such that vertical movement of a key top is guided with a guide member constructed of a pair of link members, in which a switching portion of a circuit board disposed on a base plate is operated in response to depression of the key top. This circuit board is provided with a movable switch electrode and a fixed switch electrode, which are normally held in a separate state. When the key top is depressed, operating a switch pressing portion provided in the link member, the facing movable electrode and fixed electrode perform a switching operation.

On the circuit board, engagement members for supporting a pair of link members are provided for each key top. The engagement members is integrally formed with the circuit board by punching or stamping a predetermined portion of an aluminum plate forming the circuit board into a longitudinal groove with use of a press or the like. In a normal state, the link members are held with the respective lower ends being in a closed state due to a spring or the like that urges the key top upwards. When the key top is depressed, the link members are compressed vertically while sliding their engagement projections provided on the lower ends outwardly into an open state. To allow this, the engagement member is formed in a longitudinal grooved shape.

Furthermore, there has recently been proposed a key switch device using a membrane switch sheet having a three-layer configuration as a circuit board. This is constructed of an upper sheet having a lower face on which a predetermined circuit pattern including a movable switch electrode is provided, a lower sheet having an upper face on which a predetermined circuit pattern including a fixed switch electrode arranged facing the movable electrode is provided, and a spacer sheet disposed between the upper and lower sheets to separate the movable and fixed electrodes and provided with a switching hole in a position where the movable and fixed electrodes face each other. When this membrane switch sheet is used, an engagement member molded from metal such as aluminum, iron, and the like in a flat plate shape, is fixed on the sheet with adhesive. Examples thereof are shown in Japanese patent unexamined publications Nos. 9-190735 and 10-172380. In those devices, upper ends of a pair of link members are engaged in engagement portions formed on the underside of a key top to combine the link members.

In a manufacture process of a keyboard provided with a plurality of the key switch devices constructed as above, or in actual use by a user of an electronic apparatus such as a personal computer provided with the key switch devices, when troubles such as the mixing of foreign matters into the key switch device or malfunction therein occur, the following procedures have to be taken; pulling out the key top, checking the inside condition of the key switch device; repair or replacement thereof; and then reattaching the key top. In the case where the engagement members have been press-made in the circuit board, the pressed portions include right-angled corners of substantially 90 degrees in section, causing the engagement protrusion of the link member to snag on the edge in pulling the key top, thereby disabling the link member from being pulled out. Thus, only the key top is removed. The pair of link members combined through the respective upper ends engaged in the engagement portions of the key top are released from the engagement relation to the key top while only the lower ends are held in the engagement relation to the engagement members of the circuit board, thus allowing the link members to be held in random orientations. As a result, at reattachement of the key top, proper positioning and engaging between the link members and the key top become very difficult.

The above problem would occur not only in the case where the engagement member is integrally formed in the circuit board by a press but also in the case where the flat plate shaped engagement member is bonded to the membrane switch sheet as long as the engagement member has a corner of a sharp edge for engaging the engagement protrusion of the link member.

SUMMARY OF THE INVENTION

The present invention has been made in view of the above circumstances and has an object to overcome the above problems and to provide a key switch device with an enhanced assembling efficiency of link members to maintain high assembling efficiency of a whole key switch device while flexibly coping with the needs for a thinner key switch device, a keyboard provided with the key switch device, and an electronic apparatus provided with the keyboard.

Another object of the present invention is providing a key switch device usable for long term without deterioration in durability of link members, and provided with the link members which can be molded by a simple die constructed of upper and lower parts without using a slide die, thereby to enhance production efficiency of the link member, a keyboard provided with the key switch device, and an electronic apparatus provided with the keyboard.

Furthermore, another object of the present invention is to provide a thinner key switch device capable of restraining horizontal motion of a key top in course of depression with a simple structure, causing no increase in cost, thereby to achieve stable key operability, a keyboard provided with the key switch device, and an electronic apparatus provided with the keyboard.

Another object of the present invention is to provide a key switch device capable of simply easily reattaching a key top after pulled out, and achieving the ease in assembly, a keyboard provided with the key switch device, and an electronic apparatus provided with the keyboard.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a key switch device including: a key top provided at its underside with a first engagement portion and a second engagement portion; a third engagement portion in correspondence with the first engagement portion, and a fourth engagement portion in correspondence with the second engagement portion, both of which are arranged below the key top; a guide member for supporting the key top to guide vertical movement of the key top, the guide member including a first link member provided with a first shaft movably engaged in the first engagement portion and a third shaft movably engaged in the third engagement portion and a second link member provided with a second shaft movably engaged in the second engagement portion and a fourth shaft movably engaged in the fourth engagement portion; a first gear portion provided near the first shaft in the first link member; a second gear portion provided near the second shaft in the second link member; and a switching section for performing a switching operation in accordance with the vertical movement of the key top; the first and second link members being arranged such that, in association with the vertical movement of the key top, the first and second link members are operated in synchronization with each other through a mutual contact relationship between the first and second gear portions; wherein the first gear portion is provided with a first upper tooth portion and a first lower tooth portion which are arranged in adjacent relation in a direction of width of the first link member and in upper-and-lower relation in a direction of thickness of the first link member, the second gear portion is provided with a second upper tooth portion and a second lower tooth portion which are arranged in adjacent relation in a direction of width of the second link member and in upper-and-lower relation in a direction of thickness of the second link member, and the first upper tooth portion and the second lower tooth portion, and, the first lower tooth portion and the second upper tooth portion, are allowed to move, while maintaining mutually overlapping contact relation, in association with the vertical movement of the key top.

According to another aspect of the present invention, there is provided a keyboard provided with at least one of the immediately preceding key switch device.

According to another aspect of the present invention, there is provided an electronic apparatus including: a keyboard for inputting various data such as characters, symbols, and others, the keyboard being provided with a key switch device including: a key top provided at its underside with a first engagement portion and a second engagement portion; a third engagement portion arranged below the key top in correspondence with the first engagement portion and, a fourth engagement portion arranged below the key top in correspondence with the second engagement portion; a guide member for supporting the key top to guide vertical movement of the key top, the guide member including a first link member provided with a first shaft movably engaged in the first engagement portion and a third shaft movably engaged in the third engagement portion and a second link member provided with a second shaft movably engaged in the second engagement portion and a fourth shaft movably engaged in the fourth engagement portion; a first gear portion provided near the first shaft in the first link member; a second gear portion provided near the second shaft in the second link member; and a switching section for performing a switching operation in accordance with the vertical movement of the key top; the first and second link members being arranged such that, in association with the vertical movement of the key top, the first and second link members are operated in synchronization with each other through a mutual contact relationship between the first and second gear portions; wherein the first gear portion is provided with a first upper tooth portion and a first lower tooth portion which are arranged in adjacent relation in a direction of width of the first link member and in upper-and-lower relation in a direction of thickness of the first link member, the second gear portion is provided with a second upper tooth portion and a second lower tooth portion which are arranged in adjacent relation in a direction of width of the second link member and in upper-and-lower relation in a direction of thickness of the second link member, and the first upper tooth portion and the second lower tooth portion, and, the first lower tooth portion and the second upper tooth portion, are allowed to move, while maintaining mutually overlapping contact relation, in association with the vertical movement of the key top; display means for displaying the characters, symbols, and others; and control means for controlling the display means to display the characters, symbols, and others based on input data from the keyboard.

According to another aspect of the present invention, there is provided a key switch device including: a key top provided at its underside with a first engagement portion and a second engagement portion; a third engagement portion arranged below the key top in correspondence with the first engagement portion, and a fourth engagement portion arranged below the key top in correspondence with the second engagement portion; a guide member for supporting the key top to guide vertical movement of the key top, the guide member including a first link member provided with a first shaft movably engaged in the first engagement portion and a third shaft movably engaged in the third engagement portion and a second link member provided with a second shaft movably engaged in the second engagement portion and a fourth shaft movably engaged in the fourth engagement portion; a first gear portion provided near the first shaft in the first link member; a second gear portion provided near the second shaft in the second link member; and a switching section for performing a switching operation in accordance with the vertical movement of the key top; the first and second link members being arranged such that, in association with the vertical movement of the key top, the first and second link members are operated in synchronization with each other through a mutual contact relationship between the first and second gear portions; wherein the first gear portion is provided with a first tooth portion formed in the first link member, the second gear portion is provided with a second tooth portion formed in the second link member, and the first tooth portion of the first link member and the second tooth portion of the second link member are allowed to move, while maintaining mutually overlapping contact relation, in association with the vertical movement of the key top.

According to another aspect of the present invention, there is provided a keyboard provided with one or more of the immediately preceding key switch device.

According to another aspect of the present invention, there is provided a key switch device including: a key top provided at its underside with a first engagement portion and a second engagement portion; a third engagement portion arranged below the key top in correspondence with the first engagement portion, and a fourth engagement portion arranged below the key top in correspondence with the second engagement portion; a guide member for supporting the key top to guide vertical movement of the key top, the guide member including a first link member provided with a first shaft movably engaged in the first engagement portion and a third shaft movably engaged in the third engagement portion and a second link member provided with a second shaft movably engaged in the second engagement portion and a fourth shaft movably engaged in the fourth engagement portion; a first and a second arms formed in the first link member, each of which is provided with the first shaft; a third and a fourth arms formed in the second link member, each of which is provided with the second shaft; the first link member being provided with a first gear portion formed near the first shaft of the first arm and a second gear portion formed near the first shaft of the second arm;

the second link member being provided with a second gear portion formed near the second shaft of the third arm and a first gear portion formed near the second shaft of the fourth arm; a switching section for performing a switching operation in accordance with the vertical movement of the key top; the first and second link members being arranged such that, in association with the vertical movement of the key top, the first and second link members are operated in synchronization with each other through a mutual contact relationship between the first gear portion of the first arm and the second gear portion of the third arm and through a mutual contact relationship between the second gear portion of the second arm and the first gear portion of the fourth arm; wherein each of the first gear portions in the first arm of the first link member and the fourth arm of the second link member is provided with a first tooth portion; each of the second gear portions in the second arm of the first link member and the third arm of the second link member is provided with a second tooth portion; and the first tooth portion of the first arm and the second tooth portion of the third arm, and, the second tooth portion of the second arm and the first tooth portion of the fourth arm, are allowed to move, while maintaining mutually overlapping contact relation, in association with the vertical movement of the key top.

According to another aspect of the present invention, there is provided an electronic apparatus including: a keyboard for inputting various data such as characters, symbols, and other, the keyboard being provided with a key switch device including: a key top provided at its underside with a first engagement portion and a second engagement portion; a third engagement portion arranged below the key top in correspondence with the first engagement portion, and a fourth engagement portion arranged below the key top in correspondence with the second engagement portion; a guide member for supporting the key top to guide vertical movement of the key top, the guide member including a first link member provided with a first shaft movably engaged in the first engagement portion and a third shaft movably engaged in the third engagement portion and a second link member provided with a second shaft movably engaged in the second engagement portion and a fourth shaft movably engaged in the fourth engagement portion; a first gear portion provided near the first shaft in the first link member; a second gear portion provided near the second shaft in the second link member and in contact with the first gear portion; and a switching section for performing a switching operation in accordance with the vertical movement of the key top; the first and second link members being arranged such that, in association with the vertical movement of the key top, the first and second link members are operated in synchronization with each other through a mutual contact relationship between the first and second gear portions, wherein the first gear portion is provided with a first tooth portion formed in the first link member, the second gear portion is provided with a second tooth portion formed in the second link member, and the first tooth portion of the first link member and the second tooth portion of the second link member are allowed to move, while maintaining mutually overlapping contact relation, in association with the vertical movement of the key top; display means for displaying the characters, symbols, and others; and control means for controlling the display means to display the characters, symbols, and others based on input data from the keyboard.

According to another aspect of the present invention, there is provided a key switch device including: two upper engagement portions provided extending downward from an underside of a key top; two lower engagement portions arranged below the key top in correspondence with the upper engagement portions respectively; a guide member for supporting the key top to guide vertical movement thereof, the guide member including a first link member provided with a first engagement member engaged in one of the upper engagement portions and a third engagement member engaged in one of the lower engagement portions and a second link member provided with a second engagement member engaged in the other upper engagement portion and a fourth engagement member engaged in the other lower engagement portion; a switching member for performing a switching operation in accordance with the vertical movement of the key top; wherein the third engagement member of the first link member is slidably engaged in one of the lower engagement portions and the fourth engagement member of the second link member is slidably engaged in the other engagement portion, and motion restraining means for restraining horizontal motion of the key top in course of depression is disposed between one of the lower engagement portions and first link member and between the other lower engagement portion and the second link member.

According to another aspect of the present invention, there is provided a keyboard provided with one or more of the immediately preceding key switch device.

According to another aspect of the present invention, there is provided an electronic apparatus including: a keyboard for inputting various data such as characters, symbols, and others, the keyboard being provided with a key switch device including: two upper engagement portions provided extending downward from an underside of a key top; two lower engagement portions arranged below the key top in correspondence with the upper engagement portions respectively; a guide member for supporting the key top to guide vertical movement thereof, the guide member including a first link member provided with a first engagement member engaged in one of the upper engagement portions and a third engagement member engaged in one of the lower engagement portions and a second link member provided with a second engagement member engaged in the other upper engagement portion and a fourth engagement member engaged in the other lower engagement portion; a switching member for performing a switching operation in accordance with the vertical movement of the key top; wherein the third engagement member of the first link-member is slidably engaged in one of the lower engagement portions and the fourth engagement member of the second link member is slidably engaged in the other engagement portion, and motion restraining means for restraining horizontal motion of the key top in course of depression is disposed between one of the lower engagement portions and first link member and between the other lower engagement portion and the second link member; display means for displaying the characters, symbols, and others; and control means for controlling the display means to display the characters, symbols, and others based on input data from the keyboard.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of preferred embodiments of a key switch device, a keyboard provided with the key switch device, and an electronic apparatus provided with the keyboard embodying the present invention will now be given referring to the accompanying drawings.

Figure 1A:
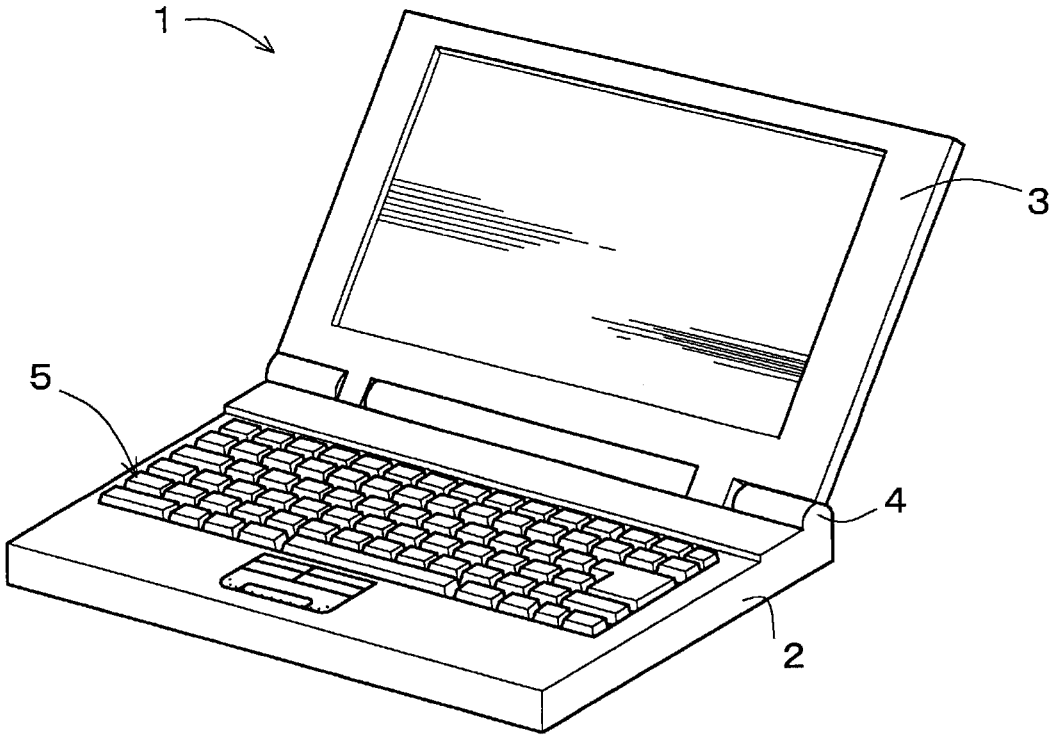
FIG. 1A is a perspective view of a notebook-size personal computer in a first embodiment according to the present invention.

A first embodiment according to the present invention will be described below in relation to a notebook-size personal computer which is an example of the electronic apparatus. FIG. 1A is a perspective view of the notebook-size personal computer and FIG. 1B is a block diagram of an electric structure of the computer.

In FIG. 1A, a notebook-size personal computer 1 is basically constructed of a main unit 2 including a CPU for conducting various processes and a display 3 mounted on the main unit 2. This display 3 is rotatably supported by a connecting portion 4 of the main unit 2 so that the display 3 opens and closes with respect to the main unit 2. The main unit 2 is provided with a keyboard 5 with a plurality of key switch devices arranged.

Figure 1B:
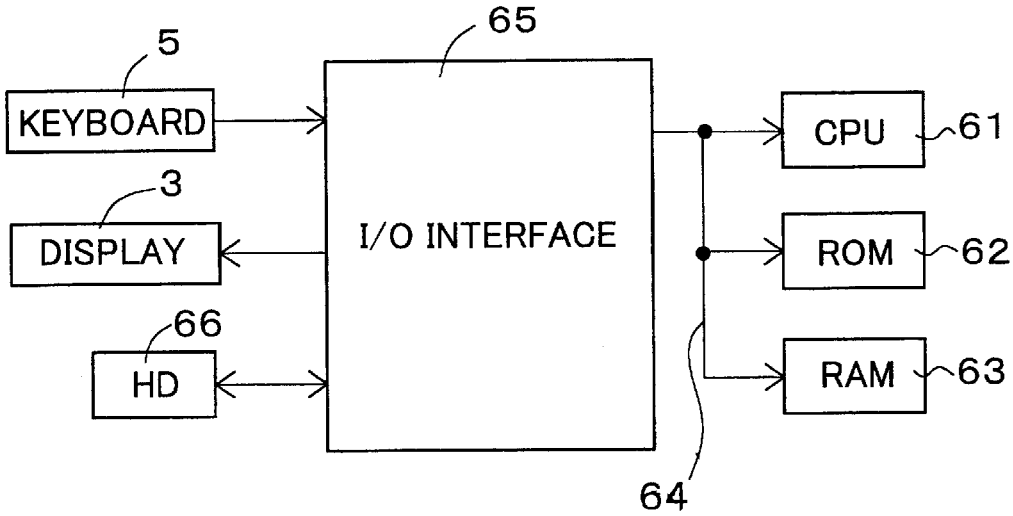
FIG. 1B is a block diagram of an electric structure of the notebook-size personal computer in the present embodiment.

In FIG. 1B, a CPU 61 is connected through a bus 64 to a ROM 62 which stores programs for controlling each section of the personal computer and to a RAM 64 for storing various data. The CPU 61 is also connected to an input/output (I/O) interface 65 through the bus 64. This I/O interface 65 is connected to the display 3, the keyboard 5, and a hard disc device 66 which stores programs for word processing, tabular calculations, etc. The CPU 65 reads the programs for word processing, tabular calculations, etc. from the hard disc device 66 to carry out in response to input data from the keyboard 5, and causes the display 3 to display thereon characters and symbols.

Figure 2:
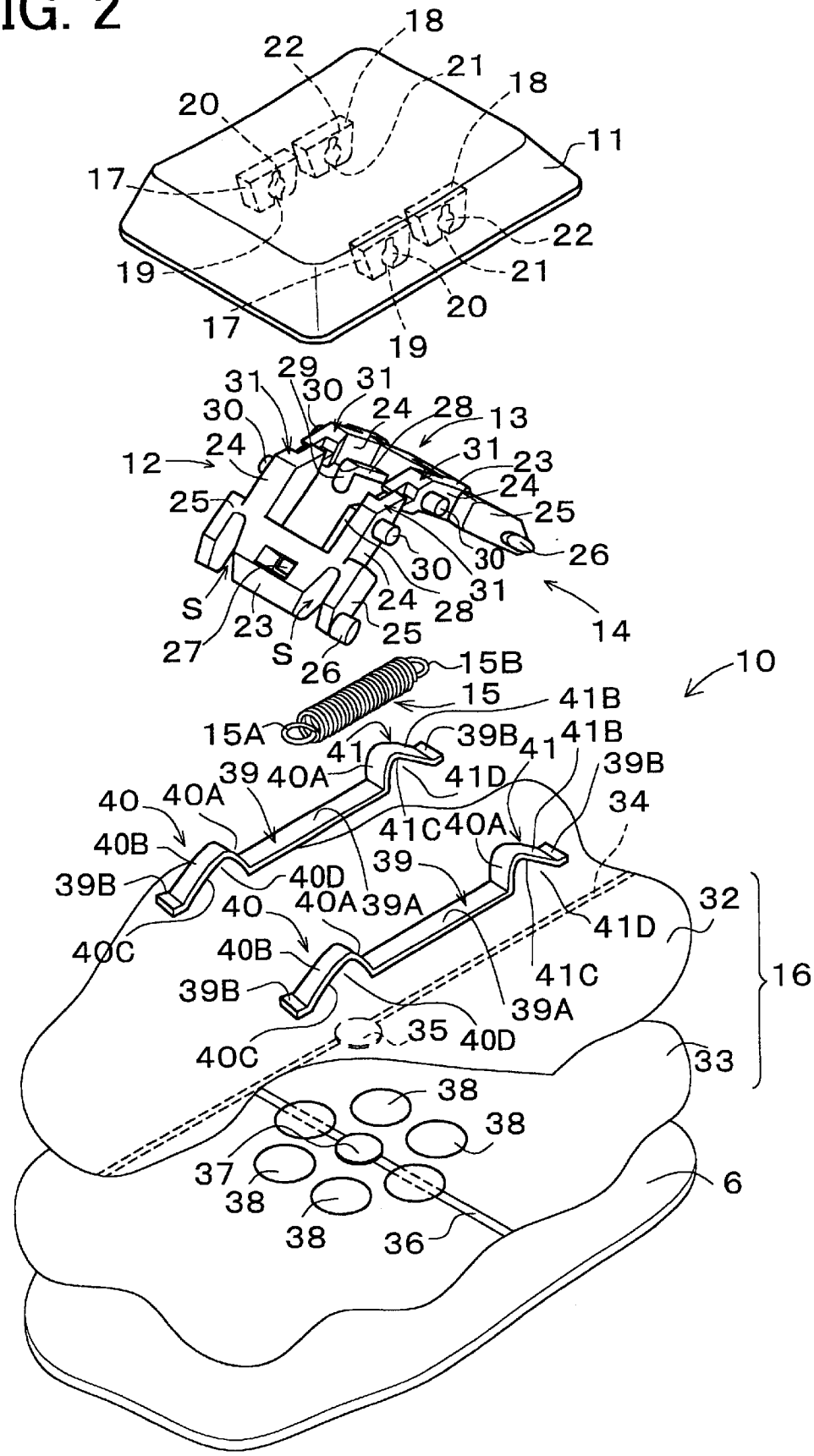
FIG. 2 is an exploded perspective view of a key switch device in the first embodiment.
Figure 3:
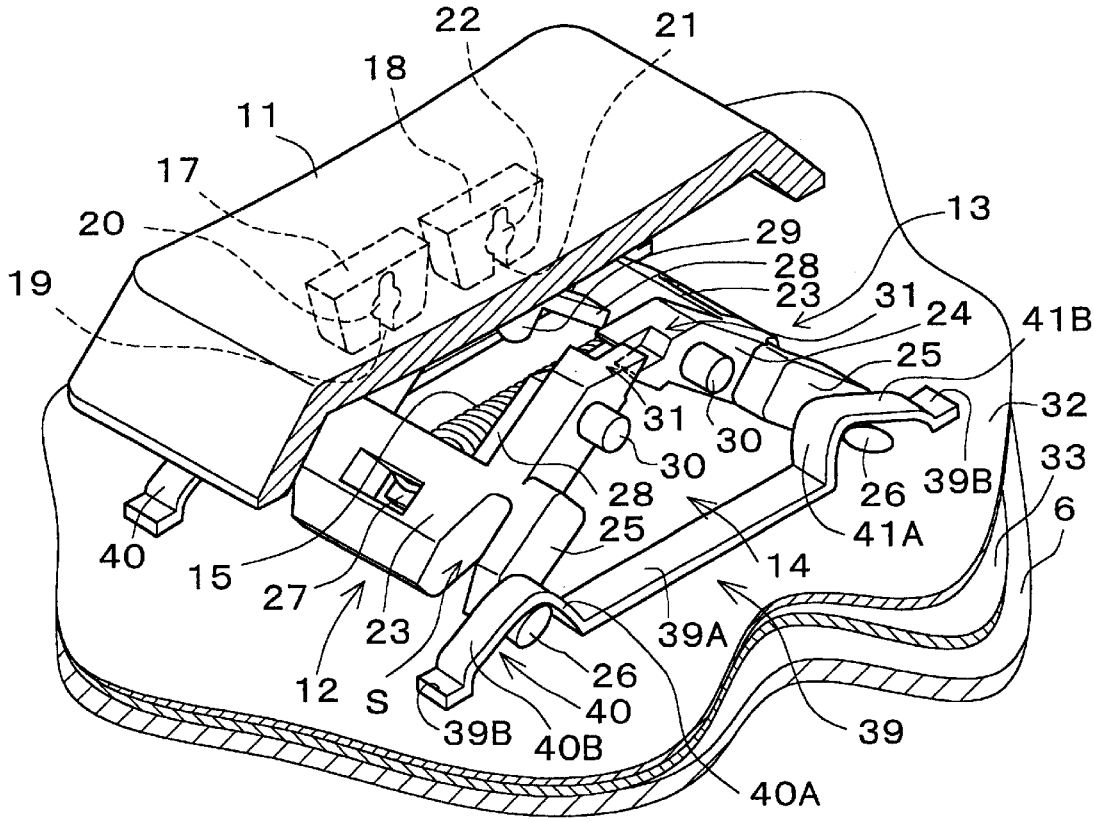
FIG. 3 is a perspective view of the key switch device of which a part is omitted.
Figure 4:
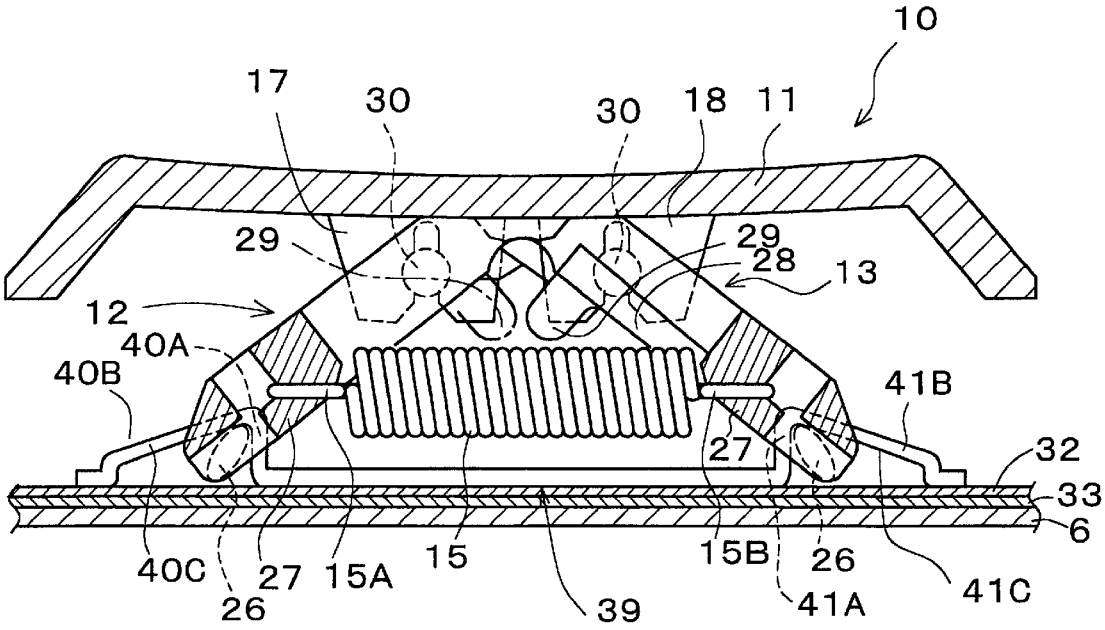
FIG. 4 is a sectional view of the key switch device.

A key switch device provided in the keyboard 5 of the notebook-size personal computer 1 is explained below with reference to FIGS. 2–4. FIG. 2 is an exploded perspective view of the key switch device in the first embodiment. FIG. 3 is a perspective view of the key switch device of which a part is omitted. FIG. 4 is a sectional view of the key switch device.

As shown in FIGS. 2–4, a key switch device 10 is basically constructed of a key top 11, a guide member 14 made up of a pair of a first and second link members 12 and 13 for supporting the key top 11 to guide vertical movement thereof, a coil spring 15 disposed between the first and second link members 12 and 13, thereby urging them in a direction to move respective lower ends inwardly, or closer to each other (a closing direction), and a membrane switch sheet 16 disposed under the guide member 14. It is to be noted that a support plate 6 is disposed under the membrane switch sheet 16. The key switch device 10 is entirely supported on the support plate 6.

The key top 11 is formed of a resin material such as an ABS resin, and a character, etc. is printed on the upper surface of the key top 11. On the underside of the key top 11, there is provided a pair of first engagement portions 17 and 17 (left ones in FIGS. 2–4) arranged along a shorter side of the key top 11. In parallel to the first engagement portions 17 and 17, a pair of second engagement portions 18 and 18 (right ones in FIGS. 2–4) is arranged. The first engagement portion 17 is formed with a vertical notch 19 opening at a lower end thereof end and a circular bearing hole 20 formed continuously to the notch 19. Like the first engagement portion 17, the second engagement portion 18 is formed with a vertical notch 21 opening at a lower end thereof and a circular bearing hole 22 formed continuously to the notch 21. An upper support shaft 30 of the first link member 12 mentioned later is inserted in the bearing hole 20 of the first engagement portion 17 through the vertical notch 19 and there rotatably supported. An upper support shaft 30 of the second link member 13 mentioned later is inserted in the bearing hole 22 of the second engagement portion 18 through the notch 21 and there rotatably supported. It is to be noted that the first and second engagement portions 17 and 18 may be integrally formed with the key top 11 or formed independently and fixed on the underside of the key top 11.

The guide member 14 is constructed of the first and second link members 12 and 13 to support the key top 11 for guiding vertical movement of the same. The first link member 12 is formed of a resin such as polyacetal in one body configuration basically having a plate-like base portion 23 and a pair of arms 24 extending from both sides of the base portion 23, thus having a substantial U-shaped configuration as viewed in plan. At joint portions between the arms 24 and both sides of the base portion 23, a pair of shaft support portions 25 is formed extending and bending downwards. A lower support shaft 26 is provided protruding outwards on each lower end of the shaft support portions 25. This support shaft 26 has an elliptic shape in side view of the guide member 14. The support shafts 26 are each slidably received in a slide groove of a third engagement portion 40 of an engagement member 39 bonded to the membrane switch sheet 16, mentioned later.

A space S is produced between each side surface of the base portion 23 and the inner side surface of each of the shaft support portions 25. This space S permits the shaft support portion 25 to elastically deform with respect to the joint portion serving as a base point. The elastic deformation of the shaft support portion 25 is utilized when the support shaft 26 is inserted in the slide groove of the third engagement portion 40 of the engagement member 39.

A spring engagement portion 27 is provided protruding downward from the underside of the base portion 23 at about a center in the length direction and width direction of the base portion 23. This spring engagement portion 27 has a hooked portion for seating thereon an end 15A of the coil spring 15. Furthermore, an elastic piece 28 is provided extending inwardly from the inner side surface of the base portion 23 between the arms 24, in a position off the center of the base portion 23 in its length direction (a position off to the right side in FIGS. 2 and 3), and in parallel to the arms 24. This elastic piece 28 is provided with a switch pressing protrusion 29 in the tip end (see FIG. 4).

An upper support shaft 30 is formed protruding outwards in each of the arms 24 of the first link member 12. The support shaft 30 is rotatably received in the bearing hole 20 of the first engagement portion 17 provided on the underside of the key top 11. The arm 24 is provided with a gear portion 31 in the tip end. The structure of this gear portion 31 will be mentioned later.

The second link member 13 has the same structure as that of the first link member 12. The link member constructed as above can be used in common as the second link member 13. As shown in FIGS. 2–4, therefore, there generates no assembly orientation of the first and second link members 12 and 13 when assembled to make up the guide member 14. As a result, the guide member 14 can be easily constructed without needing special care to the assembly orientation.

As constructed in common with the first link member 12, the second link member 13 is given the same numbers with respect to structural elements as those of the first link member 12. The detailed explanation thereof is referred to the above description on the first link member 12 and omitted in the present embodiment.

The upper support shafts 30 of the second link member 13 are each rotatably engaged in the bearing hole 22 of the second engagement portion 18. The lower support shafts 26 of the second link member 13 are each slidably engaged in the slide groove of a fourth engagement portion 41 of the engagement member 39 bonded to the membrane switch sheet 16.

A spring engagement portion 27 provided on the underside of the base portion 23 in the second link member 13 is engaged with the other end 15B of the coil spring 15. In the second link member 13, an elastic piece 28 is provided protruding inwardly from the inside surface of the base portion 23 between the arms 24, in parallel thereto, and in a position off to the left as shown in FIGS. 2 and 3. Accordingly, a pressing protrusion 29 of the elastic piece 28 of the second link member 13 is arranged at a predetermined distance with respect to the pressing protrusion 29 of the first link member 12. Either of the pressing protrusions 29 of the first and second link-members 12 and 13 may be used to press from above a movable switch electrode 35 of the membrane switch sheet 16. The gear portions 31 of the second link member 13 are engaged with the corresponding gear portions 31 of the first link member 12 so that the link members 12 and 13 are operated synchronously. The detailed structure thereof will be mentioned later.

The coil spring 15 is disposed between the first and second link members 12 and 13 with the end 15A seated over the spring engagement portion 27 of the first link member 12 and the other end 15B seated over the spring engagement portion 27 of the second link member 13. This coil spring 15 urges the first and second link members 12 and 13 in the closing direction so that respective lower ends are moved closer to each other.

The membrane switch sheet 16 is basically constructed of the upper switching sheet 32 and a lower switching sheet 33. The upper switching sheet 32 is provided with a circuit pattern 34 and a movable switch electrode 35 connected to the circuit pattern 34 on the underside. The lower switching sheet 33 is provided with a circuit pattern 36 disposed in matrix or perpendicular relation with respect to the circuit pattern 34 and a fixed switch electrode 37 on the upper face. The fixed switch electrode 37 is connected to the circuit pattern 36 and arranged to face the movable switch electrode 35. On the lower switching sheet 33, there are arranged a plurality of spacer pads 38 around the fixed switch electrode 37. These spacer pads 38 are formed by printing adhesive or the like with a predetermined film thickness. They serve to separate the movable switch electrode 35 and the fixed switch electrode 37.

On the upper face of the upper switching sheet 32, a pair of engagement members 39 each having a predetermined length are bonded with adhesive or the like in parallel arrangement at a predetermined interval therebetween. The engagement member 39 is formed of a metal, resin, or the like which may be selected from various kinds. At one end of the engagement member 39 (a left end in FIGS. 2–4) is formed a third engagement portion 40 with a longitudinal groove, while at the other end (a right end in FIGS. 2–4) is formed a fourth engagement portion 41 with a longitudinal groove. The third engagement portion 40 is used for slidably receiving the support shaft 26 of the first link member 12. The fourth engagement portion 41 is used for slidably receiving the support shaft 26 of the second link member 13.

To be more specific, the engagement member 39 is constructed of a center portion 39A to be bonded on the sheet 32, the engagement portions 40 and 41 provided at both sides of the center portion 39A, and end portions 39B provided at outer sides of the engagement portions 40 and 41.

The engagement portions 40 and 41 include wall portions 40A and 41A upturned from both ends of a center portion 39A and sloped portions 40B and 41B sloping from the wall portions 40A and 41A outwardly, or toward the end portions 39B respectively. The undersides of the sloped portions 40B and 41B provide inclined surfaces 40C and 41C.

The wall portions 40A and 41A function for holding the key top 11 in the non-depression position when the support shafts 26 of the first and second link members 12 and 13 come into contact with the wall portions 40A and 41A. This will be mentioned later in detail. Effects and actions between the inclined surfaces 40C and 41C of the sloped portions 40B and 41B and the support shafts 26 will also be described later.

In the present embodiment, the reason why the support shaft 26 has an elliptic shape is explained as follows.

The engagement portions 40 and 41 of the engagement member 39 include the sloped portions 40B and 41B each downward sloping from the wall portions 40A and 41A to each outward end of the engagement member 39. Accordingly, a slide groove 40D (41D) formed between the upper switching sheet 32 and the engagement portion 40 (41) is gradually reduced in height from the wall portion 40A (41A) side toward the end portion 39B. Thus, part of the support shaft 26 inserted in the groove 40D (41D) is constantly in contact with the inclined surface 40C (41C) of the sloped portion 40B (41B). The support shaft 26 is slid outwardly in the groove 40D (41D) as the key top 11 is depressed while turning the longitudinal axis of the elliptic form to a horizontal situation as mentioned later. This is to prevent the generation of a larger contact force than is required between the support shaft 26 and the inclined surface 40C (41C).

Figure 6:
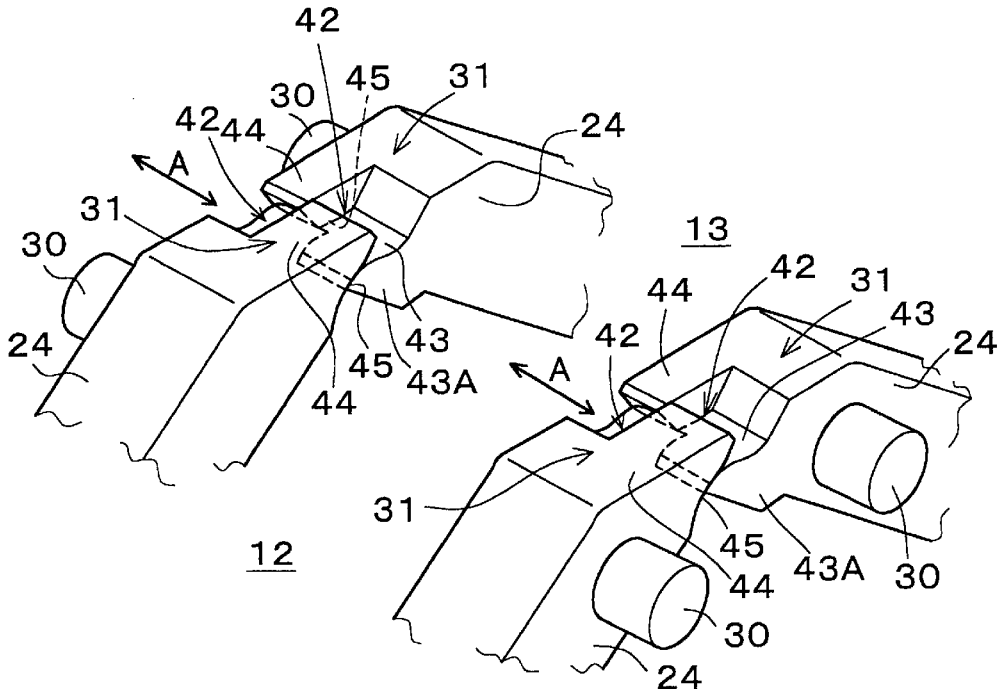
FIG. 6 is a perspective partial enlarged view of gear portions provided arms of a first and second link members.

Next explanation is made on the structure of each of the gear portions 31 formed in the tip ends of the arms 24 in the first and second link members 12 and 13. FIG. 6 is a perspective partial view of the gear portions 31 in the first and second link members 12 and 13.

In FIG. 6, the gear portion 31 formed in the tip end of the arm 24 in each of the first and second link members 12 and 13 includes a shoulder portion 42 at about a center in a direction A corresponding to the width of the arm 24. This shoulder portion 42 provides a lower protrusion 43A and an upper protrusion 44 in the tip end of the arm 24. The upper surface of the lower protrusion 43A constitutes a lower tooth portion 43 having a predetermined curved surface. The lower surface of the upper protrusion 44 constitutes an upper tooth portion 45 formed with a curved surface which is allowed to make close contact with the curved surface of the lower tooth portion 43.

The lower tooth portion 43 and the upper tooth portion 45 have a positional relationship shown in FIG. 6 such that they are arranged in adjacent relation in the width direction A of the arm 24 as viewed in plan and in upper-and-lower relation as viewed in side. The first and second link members 12 and 13 have the same structure as mentioned above. In the gear portion 31 of the arm 24 of the first link member 12 disposed left in FIG. 6, therefore, the lower tooth portion 43 formed on the upper surface of the lower protrusion 43A is on the left, while the upper tooth portion 45 formed on the underside of the protrusion 44 is on the right.

The second link member 13 disposed right in FIG. 6 is in opposite positional relation to the first link member 12. In the gear portion 31 of the arm 24 of the second link member 13, therefore, the upper tooth portion 45 formed on the underside of the protrusion 44 is on the left in FIG. 6, while the lower tooth portion 43 formed on the upper surface of the lower protruding 43A is on the right. Thus, the lower tooth portion 43 of the first link member 12 and the upper tooth portion 45 of the second link member 13 are brought in contact with each other. The upper tooth portion 45 of the first link member 12 and the lower tooth portion 43 of the second link member 13 are brought in contact with each other.

In the guide member 14 constructed of a combination of the first and second link members 12 and 13 as mentioned above, the upper and lower tooth portions 45 and 43 in the gear portion 31 of the first link member 12 are arranged in adjacent relation in the width direction A of the first link member 12 and in upper-and-lower relation in the thickness direction of the link member 12. Similarly, the upper and lower tooth portions 45 and 43 in the gear portion 31 of the second link member 13 are arranged contiguously in the width direction A of the second link member 13 and in upper-and-lower relation in the thickness direction of the second link member 13. As above, the upper and lower teeth portions 45 and 43 in each of the link members 12 and 13 are not aligned in the thickness direction of the link members 12 and 13. Accordingly, if only positioning the gear portions 31 of the first and second link members 12 and 13 so that the gear portions 31 come into contact with each other, the link members 12 and 13 can be assembled simply in proper engagement relation between the upper tooth portion 45 of the first link member 12 and the lower tooth portion 43 of the second link member 13 and also between the lower tooth portion 43 of the first link member 12 and the upper tooth portion 45 of the second link member 12. This makes it possible to extremely enhance assembling efficiency of the key switch device 10.

As mentioned above, the upper tooth portion 45 and the lower tooth portion 43 of the first link member 12 are disposed in laterally deviated relation from each other, or in adjacent relation in the width direction A of the first link member 12. Similarly, the upper and lower tooth portions 45 and 43 of the second link member 13 are disposed in laterally deviated relation from each other, or in adjacent relation in the width direction A of the second link member 13. Even if a reduction in thickness of the key switch device 10 is further developed, therefore, the upper and lower tooth portions 45 and 43 have not to be reduced in thickness or size. Consequently, the key switch device 10 usable for long-term in a stable condition with high durability of each tooth portion 43, 45 can be achieved.

Furthermore, the upper and lower tooth portions 45 and 43 of the first link member 12 are arranged in the upper-and-lower relation, but deviated adjacently in the width direction A of the first link member 12. The second link member 13 is as with the first link member 12. The first and second link members 12 and 13 can be produced with use of only a single die including an upper and lower parts which are opened up and down to take out a finished product, without using a slide die. This makes it possible to produce a plurality of the first and second link members 12 and 13 through one die, thereby enhancing production efficiency of the link members 12 and 13.

Figure 5:
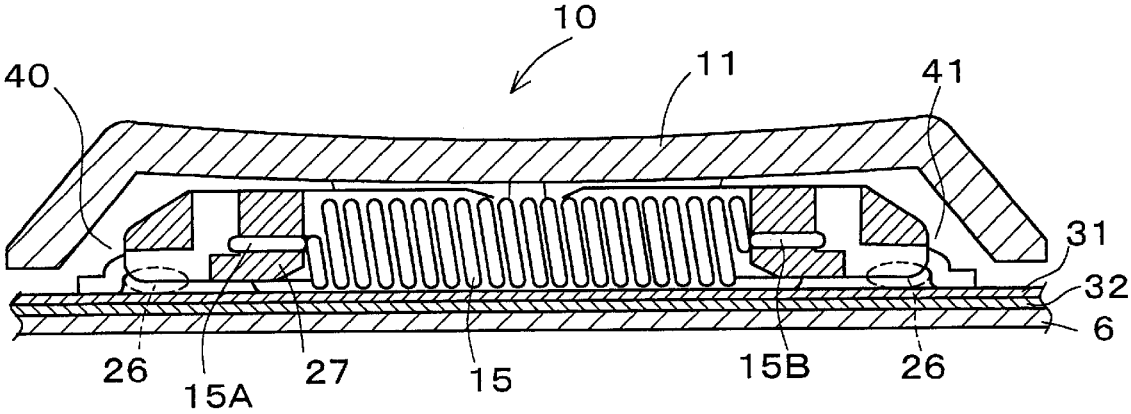
FIG. 5 is a sectional view of the key switch device in a state where a key top has been completely depressed.
Figure 7A:
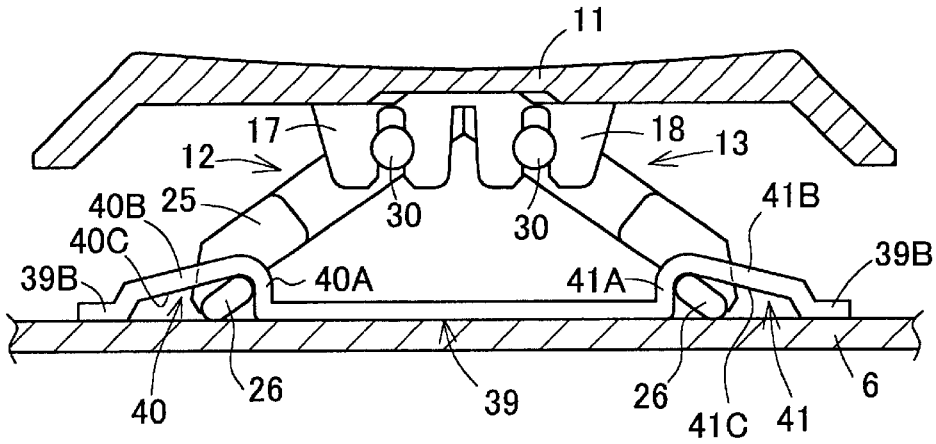
FIGS. 7A–7C are sectional views of the key switch device for explaining a switching operation while focusing attention on movements of the first and second link members, from a non-depression state of the key top to a depressed state.
Figure 7B:
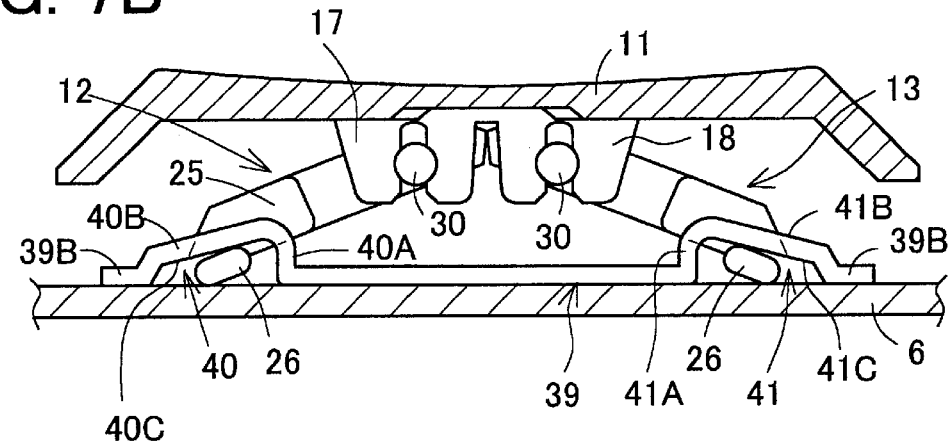
Figure 7C:
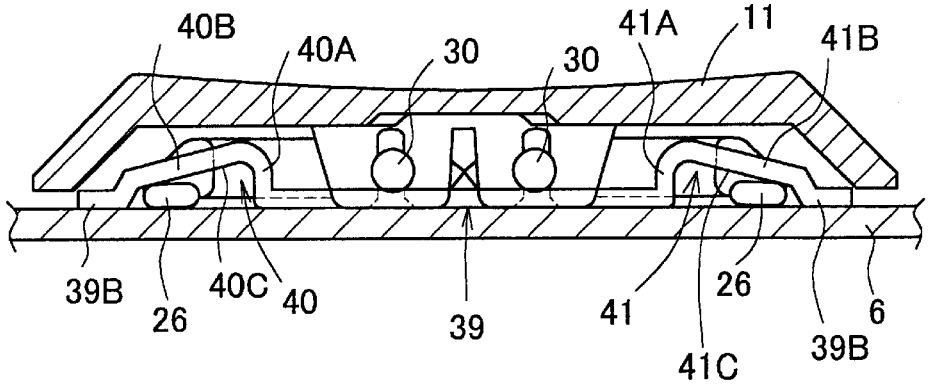

Operation of the key switch device 10 constructed as above will be described below with reference to FIGS. 2–6 and 7. FIG. 5 is a sectional view of the key switch device in a state where the key top 11 has been depressed completely. FIGS. 7A–7C shows a series of operation of the key switch device 10, in which the coil spring 15 is omitted for simplifying explanation.

As shown in FIGS. 3 and 4, the coil spring 15 is disposed between the first and second link members 12 and 13 with both ends 15A and 15B seated over the corresponding spring engagement portions 27. While the key top 11 is not depressed, this coil spring 15 urges the first and second link members 12 and 13 so that respective lower ends are moved closer to each other (in the closing direction) about the support shafts 30 rotatably supported in the baring holes 20 and 22 of the first and second engagement portions 17 and 18. At this time, each of the support shafts 26 of the first and second link members 12 and 13 is in contact with the inner surface of the wall portion 40A of the third engagement portion 40 or that of the wall portion 41A of the fourth engagement portion 41 in the engagement member 39 fixed on the upper switching sheet 32 of the membrane switch sheet 16. The key top 11 is thus stably held in the non-depression position as shown in FIGS. 4 and 7A.

In this state, the urging force of the coil spring 15 is exerted on the first and second link members 12 and 13 in the direction to move the respective lower ends of the link members 12 and 13 closer to each other. This restrains horizontal motion of the key top 11 in the non-depression position, thereby preventing rattles or unstable operation of the key top 11 resulting from the horizontal motion. Having an elliptic shape as mentioned above, each of the lower support shafts 26 of the first and second link members 12 and 13 is supported in the corresponding engagement portion 40 (41) with the upper portion making contact with the wall portion 40A (41A) and the lower portion making contact with the upper switching sheet 32 of the membrane switch sheet 16.

When the key top 11 is pushed down from the state shown in FIG. 4 against the urging force of the coil spring 15 (see FIG. 7B), each of the support shafts 30 of the first link member 12 is rotated clockwise in the bearing hole 20 of the first engagement portion 17 and each of the support shafts 30 of the second link member 13 is rotated counterclockwise in the bearing hole 22 of the second engagement portion 18. Simultaneously, each of the support shafts 26 of the first link member 12 is slid leftwards in the slide groove of the third engagement portion 40, and each of the support shafts 26 of the second link member 13 is slid rightwards in the slide groove of the fourth engagement portion 41.

The sloped portions 40B and 41B of the engagement portions 40 and 41 are gradually sloped downward from the wall portions 40A and 41A respectively toward the end portions 39B, providing a gradually reduced clearance (height) in the slide grooves 40D and 41D. Thus, the lower support shafts 26 each having an elliptic shape in side view are slid along the inclined surfaces 40C and 41C in the slide grooves 40D and 41D respectively while the upper portion is in contact with the inclined surface 40C or 41C and the lower portion is in contact with the upper switching sheet 32, so that the longitudinal axis of the elliptic shape comes to a horizontal situation. Accordingly, there occur no sliding troubles of the shafts 26 in the engagement portions 40 and 41.

In association with the above movement, the coil spring 15 is gradually stretched to move the respective lower ends of the first and second link members 12 and 13 away from each other (in an opening direction).

At this time, the lower tooth portion 43 of the first link member 12 and the upper tooth portion 45 of the second link member 13 are lowered while their contact relation is maintained. Similarly, the upper tooth portion 45 of the first link member 12 and the lower tooth portion 43 of the second link member 13 are lowered as held in contact with each other. In this manner, the first and second link members 12 and 13 are operated in complete synchronization with each other based on the cooperative action of the upper and lower tooth portions 43 and 45.

When the key top 11 is depressed at a predetermined amount (see FIG. 7C), the pressing protrusion 29 of the elastic piece 28 of the first link member 12 or the second link member 13 pushes from above the movable switch electrode 35 provided on the underside of the upper switching sheet 32. When the key top 11 is further depressed, the pressing protrusion 29 clicks and brings the movable electrode 35 into contact with the fixed electrode 37 provided on the lower switching sheet 33, thereby causing the electrodes 35 and 37 to effect a specified switching operation. At this time, the coil spring 15 is in a further stretched state as shown in FIG. 5.

In this stage, the support shafts 26 of the first and second link members 12 and 13 come into a complete horizontal situation as shown in FIG. 7C.

It is preferable that the pressing protrusions 29 of the elastic pieces 28 of the first and second link members 12 and 13 come into contact with the upper switching sheet 32 at the same time to push it. However, even when only one of the pressing protrusion 29 comes first into contact with the sheet 32, the other protrusion 29 comes into contact with the sheet 32 at substantially the same time with the former. Even if vibrations occur in the upper switching sheet 32 due to the contact of one of the protrusions 29 with the sheet 32, such the vibrations may be stopped by the contact of the other protrusion 29 with the sheet 32. Thus, chattering at the switching operation can be surely prevented.

The elastic pieces 28 may be elastically deformed when the key top 11 is further pushed down from the state shown in FIG. 7C. The elastic pieces 28 absorb the moving amount of the key top 11, or allow over-travel of the key top 11.

When the depression force applied to the key top 11 is removed after completion of the switching operation as above, the reverse operation to the above is conducted by the urging force of the coil spring 15, lifting the key top 11 to return to the non-depression position (original position) shown in FIGS. 4 and 7A.

As described above, in the key switch device 10 in the first embodiment, the upper and lower tooth portions 45 and 43 of the gear portion 31 of the first link member 12 are disposed in upper-and-lower relation and in laterally deviated relation, or adjacent in the width direction A of the first link member 12. Likewise, the upper and lower tooth portions 45 and 43 of the gear portion 31 of the second link member 13 are disposed in upper-and-lower relation and in laterally deviated relation, or adjacent in the width direction A of the second link member 13. Accordingly, the upper and lower tooth portions 45 and 43 in each of the first and second link members 12 and 13 are not provided in aligned and spaced relation in the thickness direction of the link member 12 or 13. Consequently, the first and second link members 12 and 13 can be assembled simply by meshing the gear portions 31 of the first link member 12 with those of the second link member 13, providing a proper engagement relationship between the upper tooth portion 45 of the first link member 12 and the lower tooth portion 43 of the second link member 13 and also between the lower tooth portion 43 of the first link member 12 and the upper tooth portion 45 of the second link member 12. This makes it possible to extremely enhance assembling efficiency of the key switch device 10.

In each of the gear portions 31 of the first link member 12, the upper tooth portion 45 and the lower tooth portion 43 are deviated to be adjacent in the width direction A of the first link member 12. In each of the gear portions 31 of the second link member 13, similarly, the upper and lower tooth portions 45 and 43 are deviated to be adjacent in the width direction A of the second linkmember 13. Even when a thinner key switch device 10 is developed, therefore, the upper and lower tooth portions 45 and 43 are not required to be reduced in thickness and size. Consequently, the key switch device 10 can be stably used for long-term while maintaining high durability of the tooth portions 43 and 45.

Furthermore, the upper and lower tooth portions 45 and 43 of the first link member 12 are formed in upper-and-lower relation, but deviated adjacently in the width direction A of the first link member 12. The same thing applies to the second link member 13. The first and second link members 12 and 13 can thus be produced with use of a single die including an upper and lower parts which are opened up and down to take out a finished product, without requiring a slide die. This makes it possible to produce a plurality of the first and second link members 12 and 13 with use of one die, thereby enabling enhancement of production efficiency of the link members 12 and 13.

In the key switch device 10 in the first embodiment, as mentioned above, each of the engagement portions 40 and 41 of the engagement member 39 is provided with the sloped portion 40B or 41B formed downward sloping continuously from the wall portion 40A or 41A toward the end portion 39B, which provides the inclined surface 40C or 41C. The support shafts 26 of the first and second link members 12 and 13 received in the corresponding engagement portions 40 and 41 each have an elliptic shape in side view. This elliptic shape allows the support shaft 26 to slide in contact relation with the inclined surfaces 40C and 41C in the engagement portion 40 or 41 in association with depression of the key top 11. At this time, the inclined surface 40C or 41C restrains motion of the support shaft 26 in sliding horizontally in the engagement portion 40 or 41, so that horizontal motion of the key top 11 in course of depression can be surely prevented.

Since the cooperative action of the inclined surface 40C or 41C and the support shaft 26 restrains the horizontal movement of the key top 11, a relatively large guide wall, a positioning member, and the like are not needed. The key switch device in the present embodiment can have a simple structure to achieve a reduction in cost.

The support shaft 26 having an elliptic shape is slid along the inclined surface 40C (41C) while turning the longitudinal axis of the elliptic shape to a horizontal situation in the engagement portion 40 (41) when the key top 11 is depressed. Even if the slide groove 40D (41D) defined by the sloped portion 40B (41B) becomes narrow from the wall portion 40A (41A) toward the end portion 39B, accordingly, the contact force which is generated between the elliptic support shaft 26 and the inclined surface 40C (41C) will not increase than is required. Thus, the key top 11 can be smoothly depressed without horizontal motion.

Figure 8:
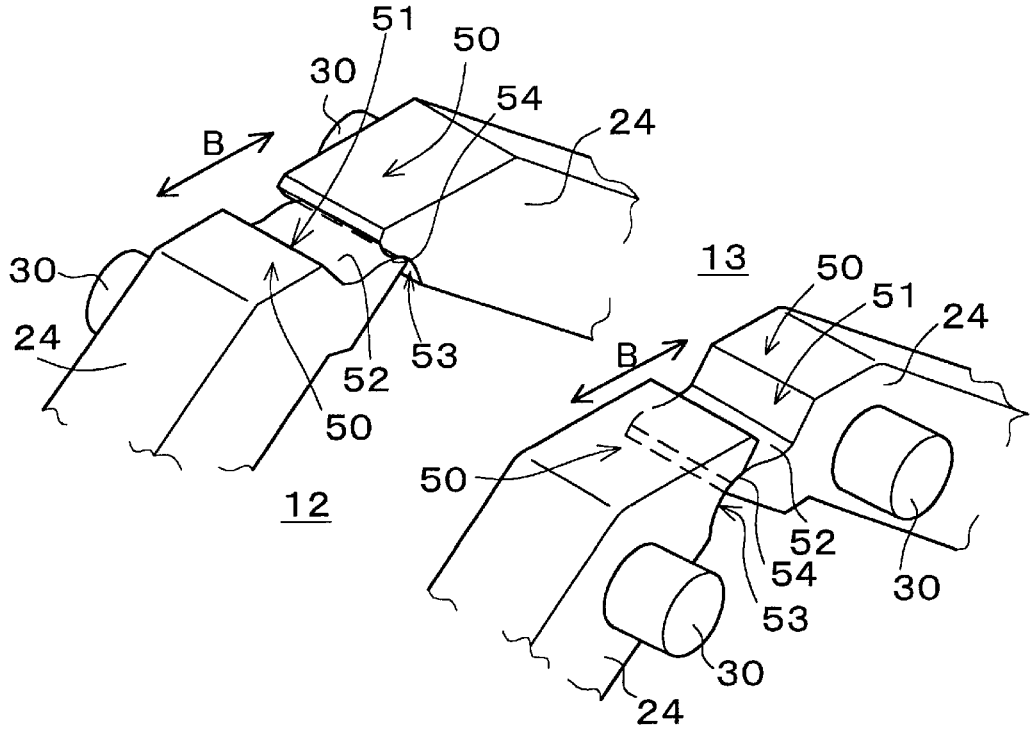
FIG. 8 is a perspective partial enlarged view of gear portions provided in a first and second link members in a second embodiment.

Next, a second embodiment of a key switch device according to the present invention is described with reference to FIG. 8. FIG. 8 is a perspective partial enlarged view of gear portions provided in a first and second link members in the second embodiment. The key switch device in the second embodiment are substantially the same in structure as the key switch device 10 in the first embodiment, except for the configuration of the gear portions. In the following explanation, therefore, only different points from the gear portion 31 in the first embodiment are mentioned. Like elements corresponding to those in the first embodiment are indicated by like numerals, with their explanation being omitted.

In FIG. 8, a first link member 12 has two arms 24 with gear portions 50 at respective tip ends. A gear portion 50 of one of the arms 24 (a left one in FIG. 8) is provided with a shoulder portion 51 formed along the entire width of the arm 24, which is perpendicular to the lengthwise direction B of the arm 24. In the lower part of this shoulder portion 51, a lower tooth portion 52 having a predetermined curved surface is provided. On the other hand, a gear portion 50 of the other arm 24 (a right one in FIG. 8) is provided with a shoulder portion 53 formed along the entire width of the arm 24, which is perpendicular to the lengthwise direction B of the arm 24. In the upper part of this shoulder portion 53, an upper tooth portion 54 having a predetermined curved surface is formed.

Likewise, a second link member 13 has two arms 24 with gear portions 50 at respective tip ends. A gear portion 50 of one of the arms 24 (a left one in FIG. 8) is provided with a shoulder portion 54 formed along the entire width of the arm 24, which is perpendicular to the lengthwise direction B of the arm 24. In the upper part of this shoulder portion 53, an upper tooth portion 54 is formed having a so curved surface as to closely fit with the curved surface of the tooth portion 52 of the first link member 12. On the other hand, a gear portion 50 of the other arm 24 (a right one in FIG. 8) is provided with a shoulder portion 51 formed along the entire width of the arm 24, which is perpendicular to the lengthwise direction B of the arm 24. In the lower part of this shoulder portion 51, a lower tooth portion 52 is formed having a so curved surface as to closely fit with the curved surface of the upper tooth portion 54 of the first link member 12.

In the first link member 12, the lower tooth portion 52 formed below the shoulder portion 51 is provided in the left arm 24, and the upper tooth portion 54 formed above the shoulder portion 53 is provided in the right arm 24. The second link member 13 has the same structure as that of the first link member 12 and is disposed on the right side in FIG. 8, opposite to the first link member 12. In the second link member 13, accordingly, in FIG. 8, the upper tooth portion 54 formed above the shoulder portion 53 is provided in the left arm 24, and the lower tooth portion 52 formed below the shoulder portion 51 is provided in the right arm 24.

With the above arrangement, the lower tooth portion 52 of the left arm 24 of the first link member 12 is disposed in overlapping contact relation with the upper tooth portion 54 of the left arm 24 of the second link member 13. Likewise, the upper tooth portion 54 of the right arm 24 of the first link member 12 is disposed in overlapping contact relation with the lower tooth portion 52 of the right arm 24 of the second link member 13.

As mentioned above, in the first link member 12, one of the arms 24 is provided with only the lower tooth portion 52, and the other arm 24 is provided with only the upper tooth portion 54. In the second link member 13, similarly, one of the arms 24 is provided with only the upper tooth portion 54 which is brought in contact with the lower tooth portion 52 of the first link member 12, and the other arm 24 is provided with only the lower tooth portion 52 which is brought in contact with the upper tooth portion 54 of the first link member 12. This configuration makes it possible to simply assemble the first and second link members 12 and 13 by putting the upper tooth portion 54 of the first link member 12 on the lower tooth portion 52 of the second link member 13, while putting the upper tooth portion 54 of the second link member 13 on the lower tooth portion 52 of the first link member 12. The key switch device 10 in the present embodiment can present significantly improved assembling efficiency.

In each of the gear portions 50 of the first and second link members 12 and 13, only a single tooth portion 54 or 52 is provided. Even when a thinner key switch device 10 is further developed, there is no need to reduce the upper tooth portion 54 and the lower tooth portion 52 in thickness and size. The key switch device 10 can also be used for long-term with high durability.

Furthermore, the above constructed first and second link members 12 and 13 can be simply produced with use of a single die including an upper and lower parts which are opened up and down to take out a finished product, without needing a slide die. This makes it possible to produce a plurality of the first and second link members 12 and 13 with use of one die, so that enhanced production efficiency of the link members 12 and 13 can be realized.

The operation of the key switch device 10 in the second embodiment is fundamentally identical to that in the first embodiment. The basic operation thereof is therefore referred to the first embodiment. The following explanation is made on only the operation of the gear portions 50 of the first and second link members 12 and 13 at the time of depression of the key top 11 of the key switch device 10 in the second embodiment, referring to FIG. 8.

As the key top 11 is depressed, the first and second link members 12 and 13 are compressed with respective lower ends moving outwardly in a direction away from each other (in the opening direction). At this time, the lower tooth portion 52 of the first link member 12 and the upper tooth portion 54 of the second link member 13 are lowered while maintaining their contact relation. The upper tooth portion 54 of the second link member 12 and the lower tooth portion 52 of the second link member 13 are also lowered while maintaining their contact relation. In this manner, the first and second link members 12 and 13 are operated in synchronization with each other through the cooperative action of the upper and lower tooth portions 54 and 52.

When the depression force applied to the key top 11 is removed, the reverse operation to the above is conducted; the first and second link members 12 and 13 are synchronously operated to lift the key top 11 up through the cooperative action of the upper and lower tooth portions 54 and 52.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention.

Figure 9:
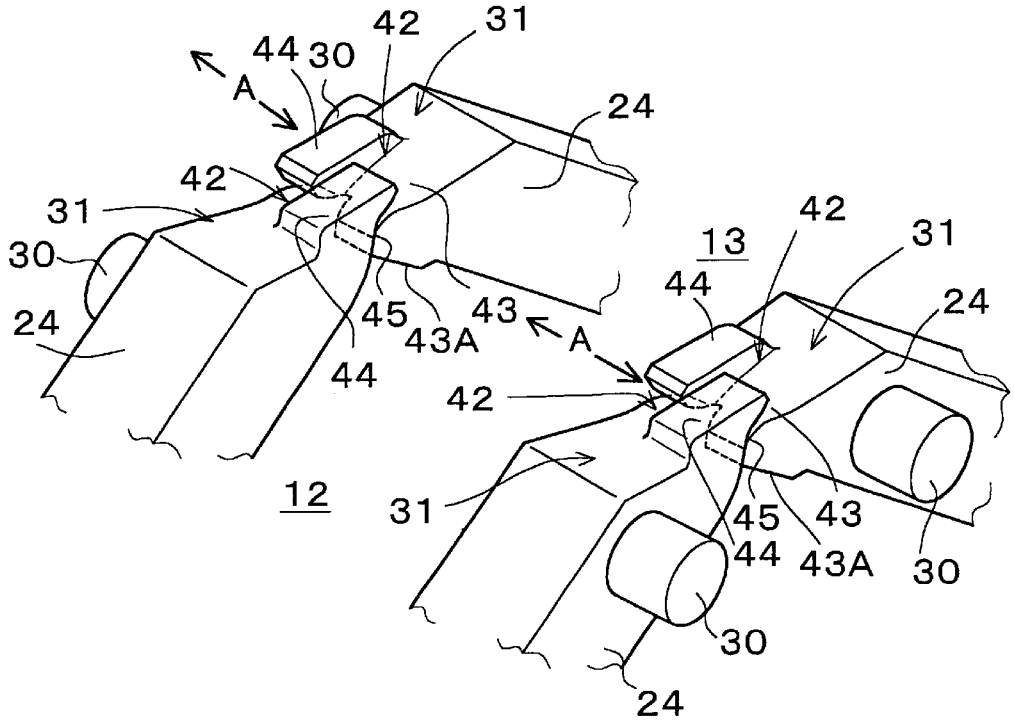
FIG. 9 is a perspective partial enlarged view of gear portions provided in a first and second link members in a first modified example in relation to the first embodiment.

For example, the gear portions 31 of the first and second link members 12 and 13 used in the key switch device 10 in the first embodiment may be alternatively structured as shown in FIG. 9. FIG. 9 is a perspective partial enlarged view of a first modified example of the gear portions 31 provided in the first and second link members 12 and 13 in the first embodiment. In FIG. 9, the structure of the gear portion 31 formed at each tip end of two arms 24 constituting the first link member 12 or the second link member 13 is basically the same as that in the first embodiment shown in FIG. 6. Different points therefrom are in only that an upper protrusion 44 protrudes upwards from the upper surface of the arm 24 through a shoulder portion 42 and a lower protrusion 43A is formed continuously from the upper surface of the arm 24 through the shoulder portion 42. Accordingly, the key switch device 10 in the first modified example can provide the same effect as in the first embodiment.

Figure 10:
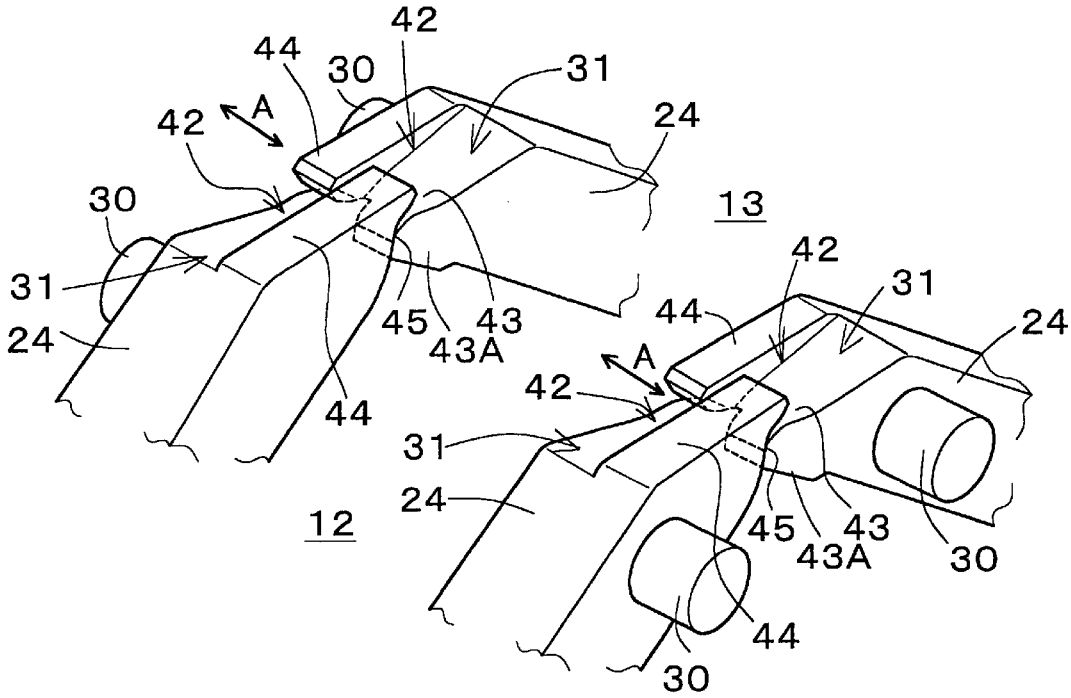
FIG. 10 is a perspective partial enlarged view of gear portions in a second modified example in relation to the first embodiment.

Alternatively, the gear portion 31 may be modified as shown in FIG. 10. FIG. 10 is a perspective partial enlarged view of a second modified example of the gear portions 31 of the first and second link members 12 and 13 in the first embodiment. In FIG. 10, the structure of the gear portion 31 formed at each tip end of two arms 24 constituting the first link member 12 or the second link member 13 is basically the same as that in the first embodiment shown in FIG. 6. Different points therefrom are in only that a shoulder portion 42 is formed over the entire upper surface of the arm 24 in its lengthwise direction so that an upper protrusion 44 is provided protruding upwards along the upper surface of the arm 24 in the lengthwise direction and that a lower protrusion 43A is provided continuously from the upper surface of the arm 24 in the lengthwise direction through the shoulder portion 42. Other elements are the same those in the first embodiment. Accordingly, the key switch device 10 in the second modified example can provide the same effect as in the first embodiment.

Figure 11:
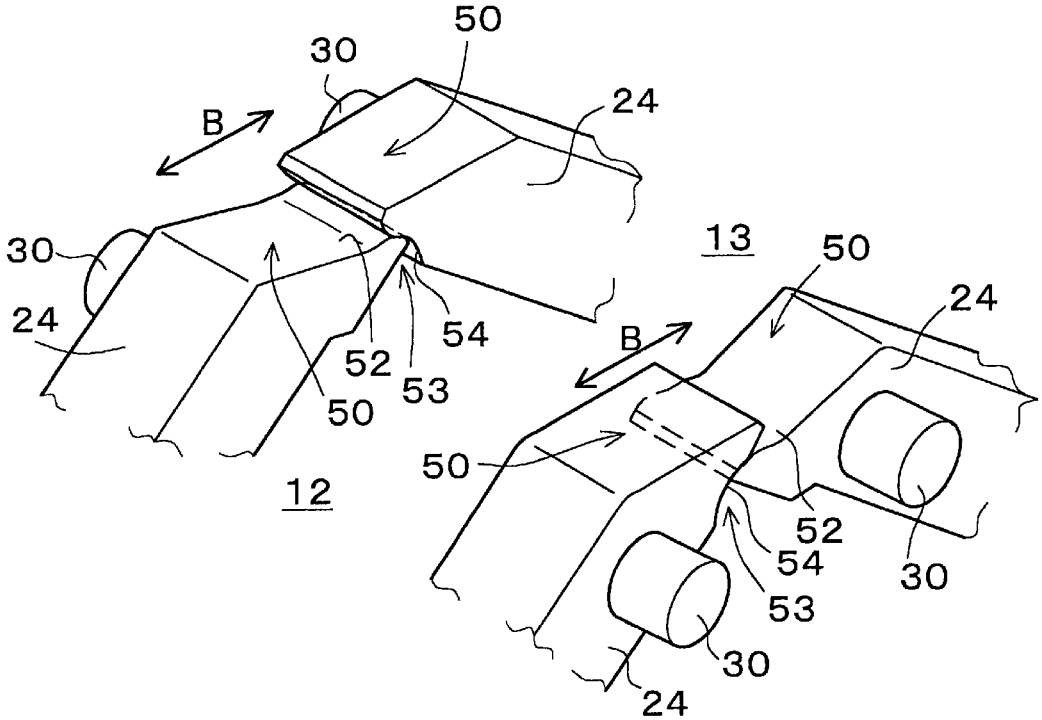
FIG. 11 is a perspective partial enlarged view of gear portions in a modified example in relation to the second embodiment.

Furthermore, the gear portions 50 of the first and second link members 12 and 13 used in the key switch device 10 in the second embodiment may be modified as shown in FIG. 11. FIG. 11 is a perspective partially enlarged view of the gear portions 50 of the first and second link members 12 and 13 in a modified example of the second embodiment. In FIG. 11, the structure of the gear portion 50 formed at each tip end of two arms 24 constituting the first link member 12 or the second link member 13 is basically the same as that in the second embodiment shown in FIG. 8. In the gear portion 50 in the second embodiment, the shoulder portion 51 is provided along the entire width of the arm 24. Differing from the second embodiment in that point, the gear portion 50 in this modification is provided with a lower tooth portion 52 formed continuously from the upper surface of the arm 24. Other elements are the same those in the second embodiment. Accordingly, the key switch device in this modification can produce the same effect as in the second embodiment.

Although the present invention is applied to the notebook-size personal computer in the above embodiments, it may be applied to different electronic apparatuses such as a typewriter, a word processor, etc., provided with a keyboard and a display.

Furthermore, in the first embodiment, the sloped portions 40B and 41B of the engagement portions 40 and 41 of the engagement member 39 are formed sloping downwards toward the end portions 39B respectively. The first and second link members 12 and 13 are each provided with the support shafts 26 being elliptic in side view, which allows the shaft 26 to slide while turning the longitudinal axis of the elliptic shape from an obliquely vertical situation to a horizontal situation as the key top 11 is depressed. However, the present invention is not limited to the above, and the following configuration may be adopted. For example, contrary to in the first embodiment, the sloped portions 40B and 41B of the engagement member 39 are formed sloping upwards from the wall portions 40A and 41A to the end portions 39B. In this case, the support shafts 26 of the first and second link members 12 and 13 are in a horizontal state during non-depression of the key top 11 and, as the key top 11 is pushed down, the shafts 26 are slid in the engagement portions 40 and 41 to go into an obliquely vertical state.

In the key switch device 10 in the first embodiment, the engagement member 39 is provided with the sloped portions 40B and 41B downward-sloping to the outward ends of the engagement member 39. The support shafts 26 having an elliptic shape are allowed to slide in the sloped engagement portions 40 and 41 respectively. Thus, the horizontal motion of the key top 11 in course of depression is restrained by the restraining force generated between the support shafts 26 and the corresponding inclined surfaces 40C and 41C. The present invention is not limited to this structure and may adopt different ones. One example thereof is shown below as a third embodiment with reference to FIGS. 12–14.

The third embodiment are different from in the first embodiment in a restricting projection 70 formed on the support portion 25 of the first and second link members and a pair of wall members integrally provided in each engagement member 39 so that the horizontal motion of the key top 11 in depression is restrained based on the cooperative action of the restricting projection and the wall member. Other elements are the same in the first embodiment and indicated by like numerals, and a detailed explanation thereof will be omitted. The following description is therefore made on only the structures peculiar to the present embodiment.

Figure 12:
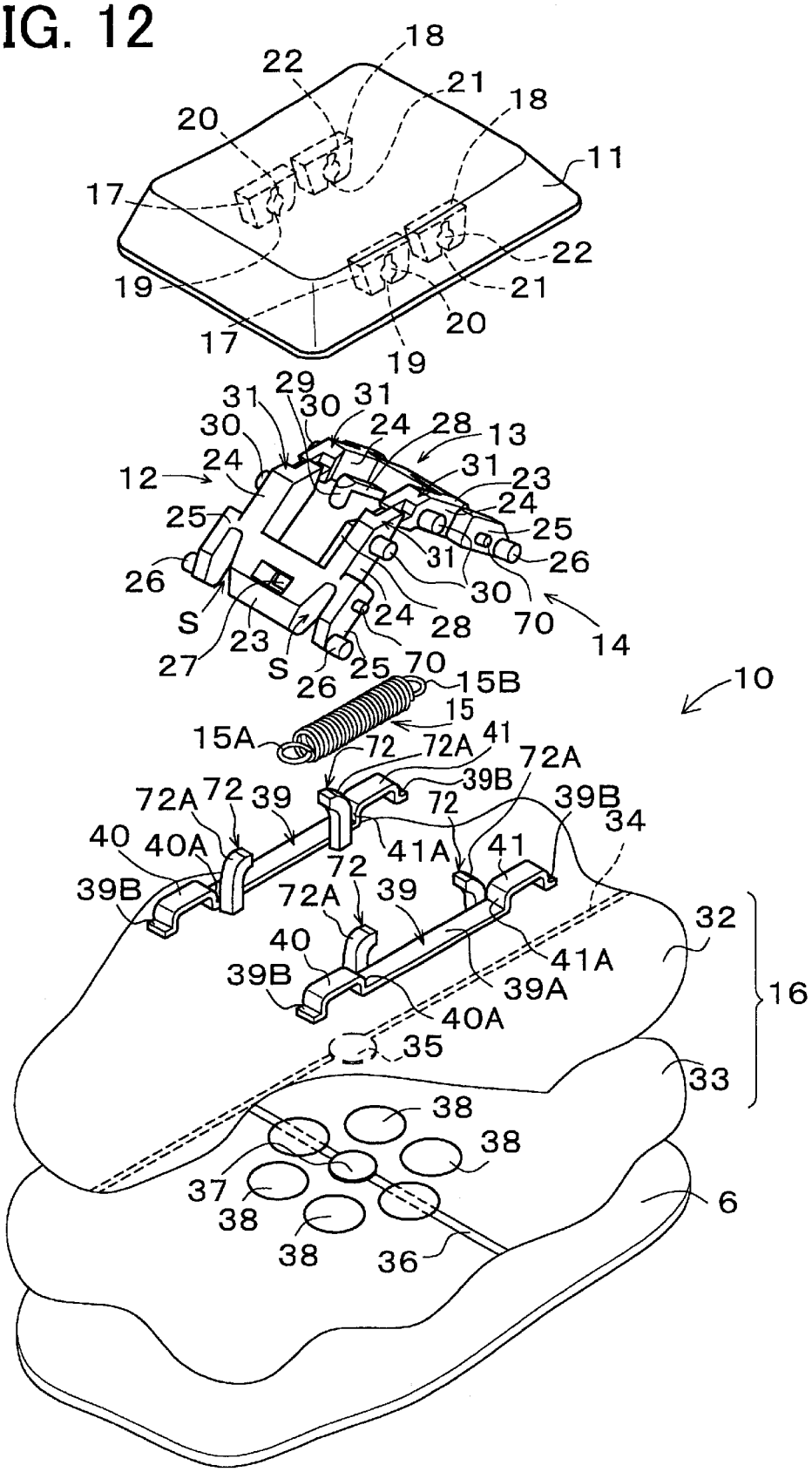
FIG. 12 is an exploded perspective view of a key switch device in a third embodiment.
Figure 13:
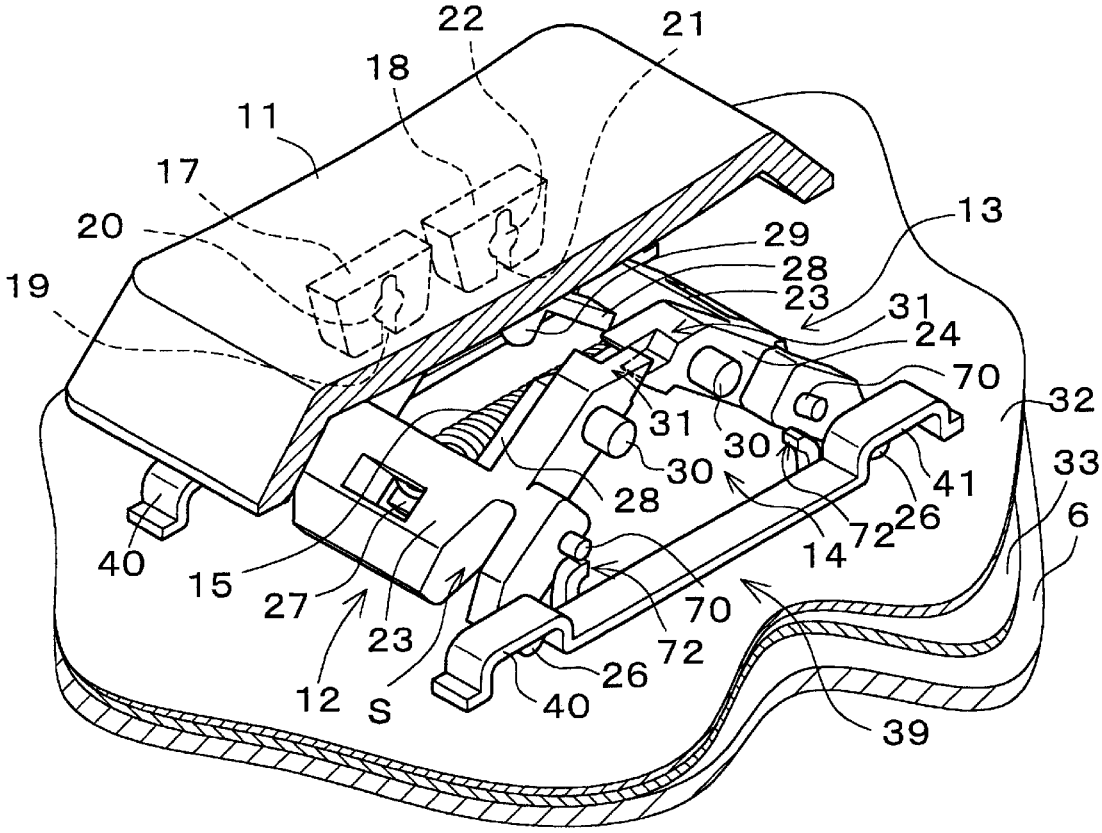
FIG. 13 is a perspective view of the key switch device of FIG. 12, a part of which is omitted.
Figure 14:
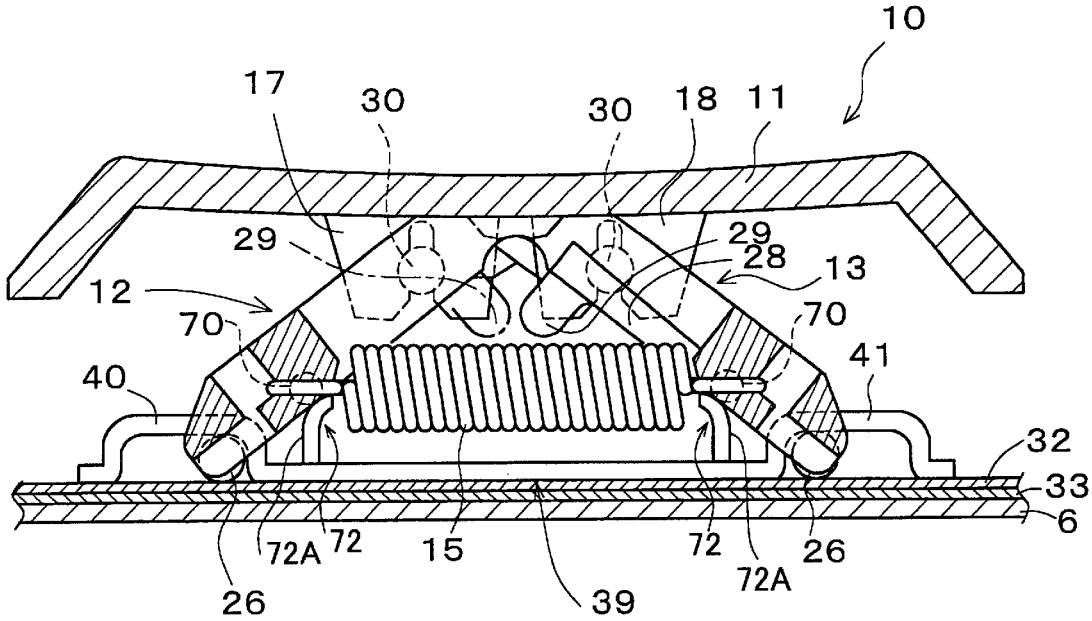
FIG. 14 is a sectional view of the key switch device of FIG. 12.

FIG. 12 is an exploded perspective view of a key switch device 10 in the third embodiment. FIG. 13 is a perspective view of the key switch device of FIG. 12, a part of which is omitted. FIG. 14 is a sectional view of the key switch device of FIG. 12.

As shown in FIGS. 12–14, the shaft support portions 25 of the first link member 12 are provided with restricting projections 70 (only one is shown in FIG. 12) formed protruding outwardly from the side surface of the shafts 25. Likewise, the shaft support portions 25 of the second link member 13 are provided with restricting projections 70 (only one is shown in FIG. 12) formed protruding outwardly from the side surface of the shafts 25.

The engagement member 39 is integrally provided with a pair of wall members 72 disposed inside at both ends near the engagement portions 40 and 41. The wall member 72 has an outer curved surface 72A as shown in FIG. 12. The restricting projection 70 is constantly in contact with the curved surface 72A of the wall member 72. Differing from the first embodiment, the engagement portions 40 and 41 have flat upper portions formed continuously from the vertical wall portions 40A and 41A toward the end portions 39B respectively, without sloped portions.

Figure 15A:
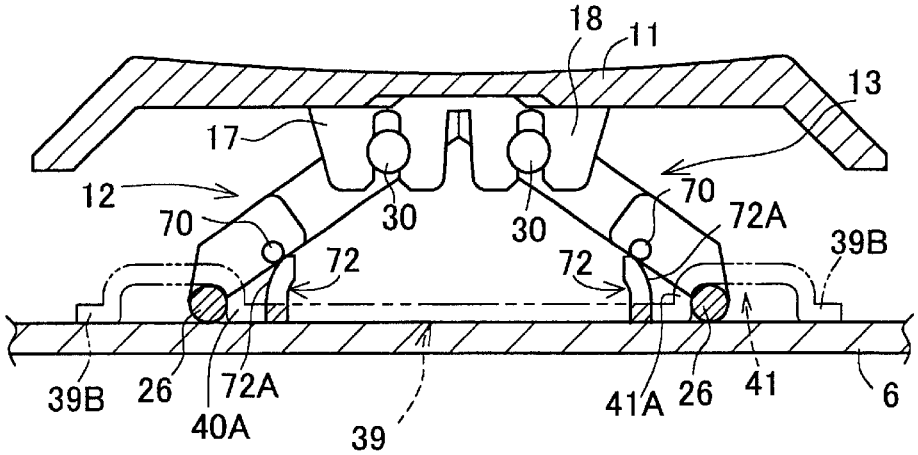
FIGS. 15A–15C are sectional views of the key switch device of FIG. 12 for explaining a switching operation in the third embodiment.
Figure 15B:
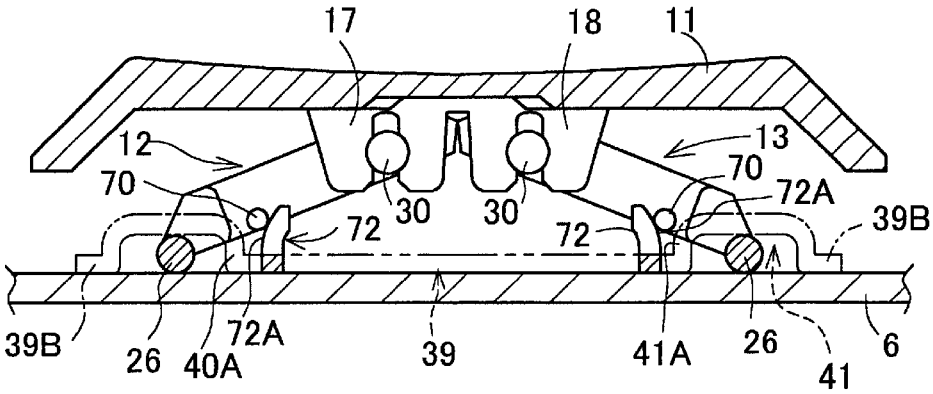
Figure 15C:
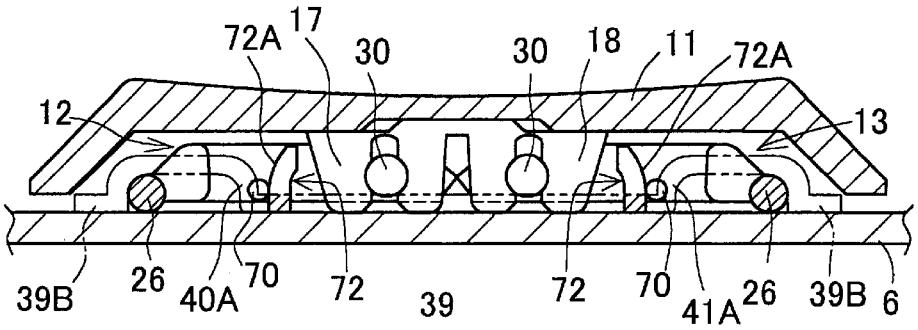

Operation of the key switch device 10 in the third embodiment is explained below with reference to FIGS. 15A–15C. FIGS. 15A–15C are sectional views of the key switch device 10 for explaining a switching operation in the third embodiment, paying attention on movements of the first and second link members 12 and 13. In these figures, the coil spring 15 is omitted for simplifying explanation.

When the key top 11 is not depressed, as shown in FIGS. 14 and 15A, the key top 11 is held in a non-depression position (original position). In this state, the urging force of the coil spring 15 acts on the link members 12 and 13 to move their lower ends closer to each other (in a closing direction). As shown in FIG. 15A, the support shaft 26 of the first link member 12 is in contact with the inner surface of the wall portion 40A of the engagement portion 40 of the engagement member 39. Likewise, the support shaft 26 of the second link member 13 is in contact with the inner surface of the wall portion 41A of the engagement portion 41 of the engagement member 39. Thus, the key top 11 is stably held in the non-depression position.

Furthermore, since the urging force of the coil spring 15 acts on the link members 12 and 13 in the closing direction, the key top 11 is not moved horizontally in the non-depression position. This can prevent rattles of the key top 11. At this time, the restricting projection 70 of each of the shaft support portions 25 of the link members 12 and 13 is in contact with the upper portion of the curved surface 72A of the wall member 72.

When the depression of the key top 11 is started, the upper shafts 30 of the first link member 12 are rotated clockwise in the bearing holes 20 of the first engagement portions 17, while the upper shafts 30 of the second link member 13 are rotated counterclockwise in the bearing holes 22 of the second engagement portions 18. Simultaneously, the support shafts 26 of the first link member 12 are slid leftwards in the engagement portions 40 of the engagement members 39, while the support shafts 26 of the second link member 13 are slid rightwards in the engagement portions 41 of the engagement members 39. During the above action, each of the restricting projections 70 is guided along the curved surface 72A in contact therewith. Based on the cooperative action of the restricting projection 70 and the curved surface 72A of the wall member 72, the key top 11 in course of depression can thus be prevented from moving horizontally. This state is shown in FIG. 15B.

When the key top 11 is further depressed, it goes into the state shown in FIG. 15C. Then, the pressing protrusions 29 of the elastic pieces 28 of the first and second link members 12 and 13 press the upper switching sheet 32 of the membrane switch sheet 16. This brings the movable electrode 35 provided on the underside of the upper switching sheet 32 into contact with the fixed electrode 37 provided on the lower switching sheet 33, thereby performing a specified switching operation. At this time, the support shafts 26 of the first and second link members 12 and 13 make contact with the opposite wall surfaces to the wall portions 40A and 41A in the engagement portions 40 and 41, as shown in FIG. 15C.

It is preferable that the pressing protrusions 29 of the elastic pieces 28 are synchronously brought in contact with the upper switching sheet 32 to press it. Even if one of the protrusions 29 first comes into contact with the sheet 32, however, the other protrusion 29 comes into contact with the sheet 32 at substantially the same time. Accordingly, vibrations generated in the sheet 32 due to the contact of one of the protrusions 29 with the sheet 32 may be stopped by the contact of the other protrusion 29 with the sheet. Thus, chattering at the switching operation can be surely prevented.

The elastic pieces 28 may be elastically deformed when the key top 11 is further depressed from the state shown in FIG. 15C. The elastic pieces 28 absorb the moving amount of the key top 11, or allow over-travel of the key top 11.

Upon removal of the depression force applied to the key top 11 after completion of the switching operation as above, the reverse operation to the above is conducted by the urging force of the coil spring 15, lifting the key top 11 to return to the non-depression position (original position) shown in FIGS. 14 and 15A.

As described above in detail, in the key switch device 10 in the third embodiment, there are provided the restricting projections 70 protruding from the side surfaces of the shaft support portions 25 of the first and second link members 12 and 13. In addition, there are provided the wall members 72 each having the curved surface 72A, integrally formed with the engagement member 39 on the inside at both ends near the engagement portions 40 and 41. With this configuration, the key top 11 can be prevented from moving horizontally based on the cooperative action of the restricting projection 70 and the curved surface 72A of the wall member 72. Restraining of the horizontal motion of the key top 11 in depression also needs no guide wall and positioning member of relatively large in height. Thus a simple structure as above can be adopted to achieve a reduction in cost.

In the above embodiments, the mechanism for restraining the horizontal motion of the key top 11 in depression is provided between the engagement member 39 and the link members 12 and 13 respectively. Alternatively, such the mechanism may be provided between the key top 11 and the link members 12 and 13 respectively.

Moreover, in the above embodiments, the mechanism for restraining the horizontal motion of the key top 11 is applied to the key switch device 10 in which the support shafts 30 of the first and second link members 12 and 13 are rotatably supported on the underside of the key top 11, while the support shafts 26 are slidably supported in the engagement portions 40 and 41 of the engagement member 39. Alternatively, the mechanism may be applied to a key switch device having a reversed engagement relationship to the above.

Next, a fourth embodiment of a key switch device according to the present invention will be described with reference to the accompanying drawings. It is to be noted that a key top and a guide member constructing a key switch device are the same in structure as in the first embodiment. Accordingly, in the fourth embodiment, only different elements and structures from in the first embodiment are explained and like elements corresponding to those in the first embodiment are indicated by like numerals.

Figure 16:
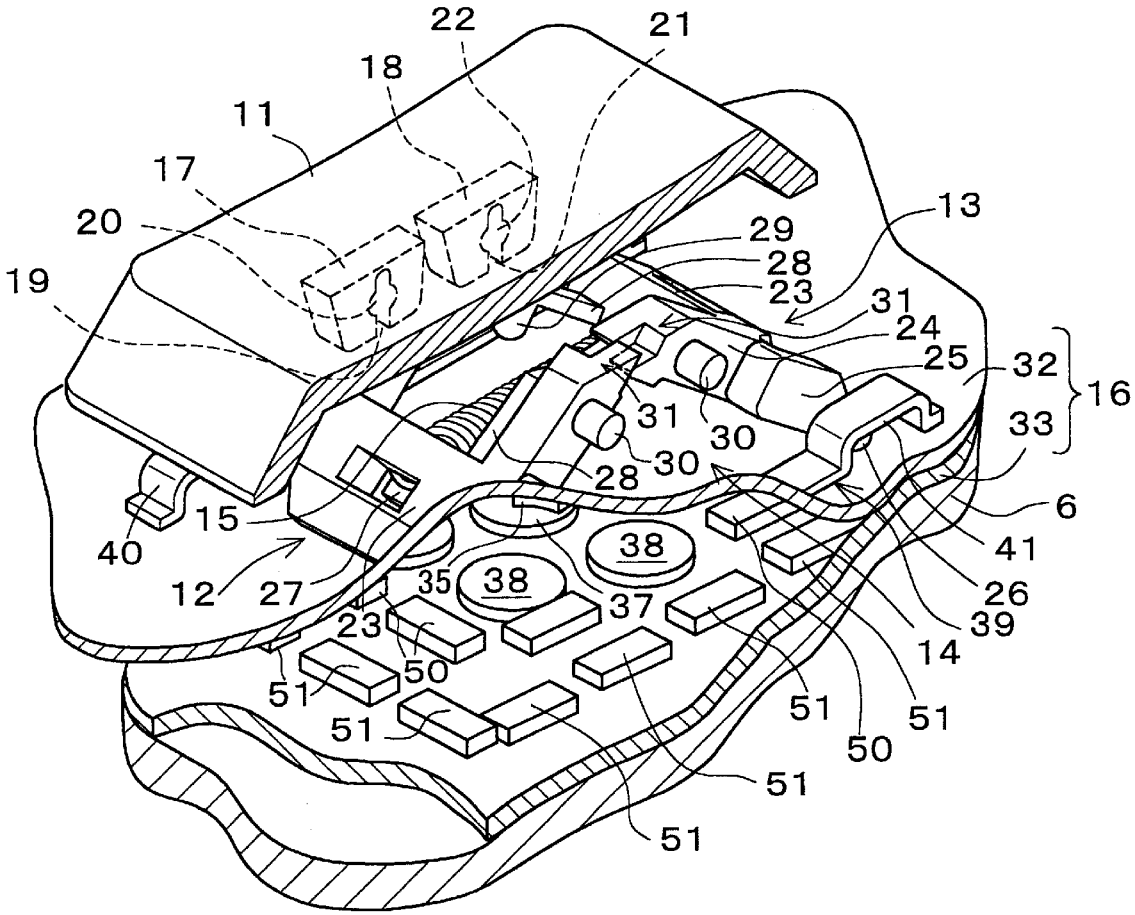
FIG. 16 is a perspective view of a key switch device in a fourth embodiment, parts of the key switch device and an upper switching sheet are omitted.
Figure 17:
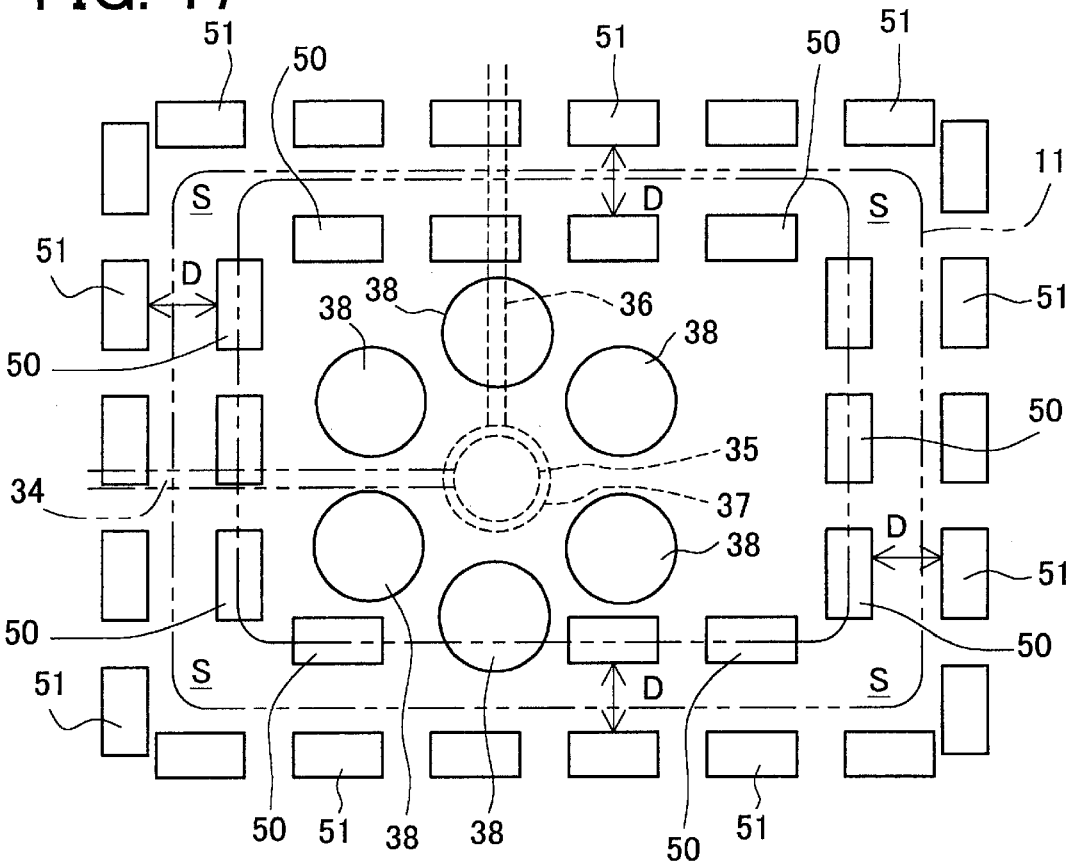
FIG. 17 is a plan view of a lower switching sheet corresponding to the key switch device of FIG. 16.

In the present embodiment, as shown in FIGS. 16 and 17, a circuit pattern 36 and a fixed switch electrode 37 are provided on a lower switching sheet 33 constituting a membrane switch sheet 16. The circuit pattern 36 is disposed in a matrix or perpendicular relation with respect to the circuit pattern 34. The fixed switch electrode 37 is disposed facing the movable switch electrode 35. On the lower switching sheet 33, there are provided dot spacer pads 38, 55, and 56 arranged around the fixed switch electrode 37.

These dot spacer pads 38, 55, and 56 are formed by printing ultraviolet cure ink, adhesive, or the like with a predetermined film thickness to separate the movable switch electrode 35 provided on the upper switching sheet 32 and the fixed switch electrode 37 provided on the lower switching sheet 33.

On the upper face of the upper switching sheet 32, a pair of engagement members 39 are bonded with adhesive in parallel to each other. The engagement member 39 is formed of a metal or resin in a longitudinal shape. The structure of the engagement member 39 is basically the same as that in the first embodiment except for the engagement portions 40 and 41 each provided with a flat upper potion.

It is to be noted that in cooperation with the support shafts 26 of the guide member 14, the engagement member 39 constitutes an engagement portion of a circuit board side for allowing engagement between the guide member 14 and the sheet 16.

Figure 18:
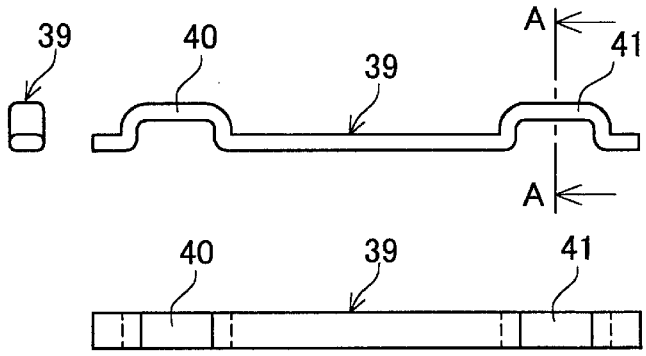
FIG. 18 is a three-view drawing of an engagement member in the fourth embodiment.
Figure 19:
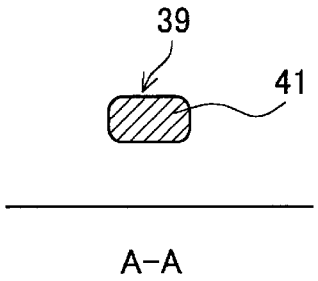
FIG. 19 is a sectional view of the engagement member taken along the line A—A in FIG. 18.
Figure 20:
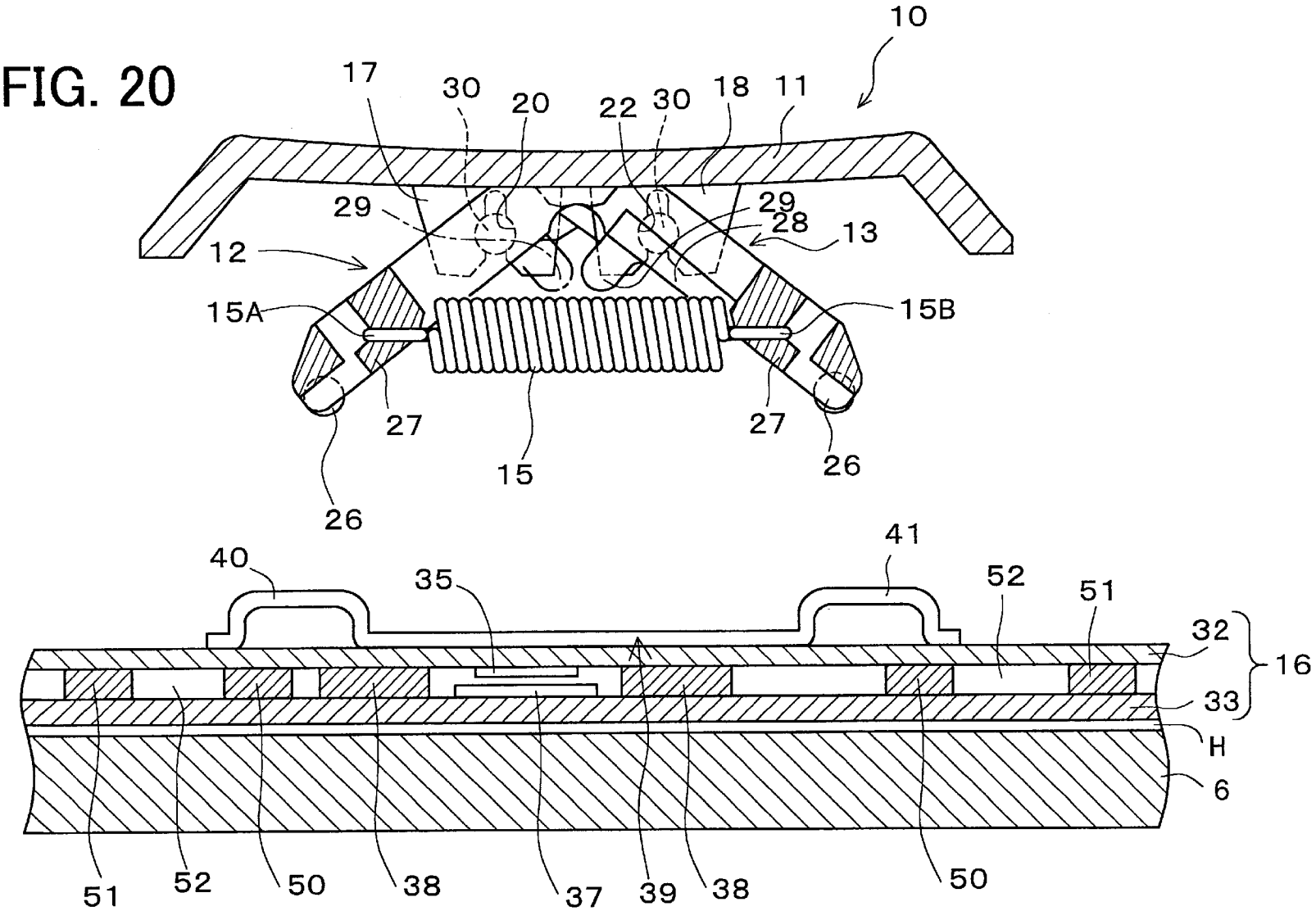
FIG. 20 is a sectional exploded view of the key switch device with a guide member released from the engagement member in the fourth embodiment.

The engagement member 39 in the present embodiment is explained below in detail, referring to FIGS. 18–20. FIG. 18 is a three-view drawing of the engagement member 39. FIG. 19 is a sectional view of the engagement member 39 taken along the line A—A in FIG. 18. FIG. 20 is a sectional exploded view of the key switch device 10 with a guide member 14 released from the engagement member 39.

The engagement member 39 is molded in the following manner; continuously drawing a linear material from a supply roll of metal such as aluminum, iron, etc. having a substantially circular shape in section; rolling the drawn material flat in top, bottom, right, and left faces in section; and cutting the flat material into chips each having a unit length of the key switch device 10 with rounded corners in section. The reason why the top and bottom faces and the right and left faces of the engagement member 39 in section are made flat is to sufficiently support the support shaft 26 of each of the first and second link members 12 and 13. On the other hand, the reason why the corners of the engagement member 39 in section are made round is to prevent the support shaft 26 from becoming snagged on the engagement member 39 when the first and second link members 12 and 13 are pulled upwards together with the key top 11.

In the fourth embodiment, as mentioned above, the engagement member 39 is produced in a simple process of molding and cutting a linear material into a predetermined shape, which eliminates the need for a pressing or stamping process on a circuit board to form engagement members therein. It is therefore unnecessary to manufacture a pressing die, so that a reduction in manufacturing cost and an early start of initial production can be realized.

It is essential only that at least the corners of the engagement member 39 to be brought in contact with the support shaft 26 are made round, but not necessarily requiring a linear material having a substantially circular shape in section. A linear material of a flat plate shape may be used if the material is ground to make corners round. The engagement member 39 may be formed of not only a metal but also a resin by a molding process.

In the key switch device 10 in the fourth embodiment, the engagement relation between the guide member 14 and the membrane switch sheet 16 through the engagement portion of the circuit board side is established easier to release than that between the guide member 14 and the key top 11 through the engagement portion of the key top side. As shown in FIG. 20, therefore, when the key top 11 is pulled upward, releasing the engagement relationship between the guide member 14 and the membrane switch sheet 16, the guide member 14 is simultaneously pulled out together with the key top 11. In this state, the support shafts 30 of the guide member 14 are received in the first and second engagement portions 17 and 18 of the key top 11 while the coil spring 15 is disposed at a substantially center in the guide member 14. The first and second link members 12 and 13 of the guide member 14 thus maintain a link relation. When the key top 11 is reattached, the support shafts 26 provided on the lower ends of the guide member 14 having the link relation can be visually observed to be positioned and inserted with respect to the third and fourth engagement portions 40 and 41 of the engagement members 39 of the membrane switch sheet 16 side. The key top 11 pulled-out can be easily reattached by simple assembly.

The dot spacer pads 38, 55, and 56 provided on the lower switching sheet 33 are explained below with reference to FIGS. 16 and 17. FIG. 17 is a plan view of the lower switching sheet 33 for the key switch device 10.

In FIGS. 16 and 17, a plurality of circular dot spacer pads 38 (six pads in this embodiment) are arranged around the fixed switch electrode 37 of the lower switching sheet 33. A plurality of rectangular dot spacer pads 55 are arranged around the electrode 37 and the pads 38. Furthermore, a plurality of rectangular dot spacer pads 56 are placed in a rectangular arrangement around a phantom rectangle (indicated by an inner two-dotted line in FIG. 17) defined by the pads 55 at a predetermined interval D from the pads 56.

With the above arrangements of the pads 55 and 56, a rectangular annular area S is produced with the interval D between the inner phantom rectangle defined by the pads 55 and the outer phantom rectangle defined by the pads 56. This area S has a shape corresponding to a rectangular lower end 11A of the key top 11 and a width (corresponding to the interval D) larger than the width d of the lower end 11A of the key top 11 (see FIG. 16).

The lower switching sheet 33 on which the above dot spacer pads 38, 55, and 56 are provided is combined with the upper switching sheet 32 to form the membrane switch sheet 16. In this state, the fixed switch electrode 37 and the movable switch electrode 35 are faced to each other at a distance corresponding to the thickness of the dot spacer pads 38. In the area S, a space 52 is provided by the dot spacer pads 55 and 56 between the lower face of the upper switching sheet 32 and the upper face of the lower switching sheet 33 (see FIG. 20).

Figure 21:
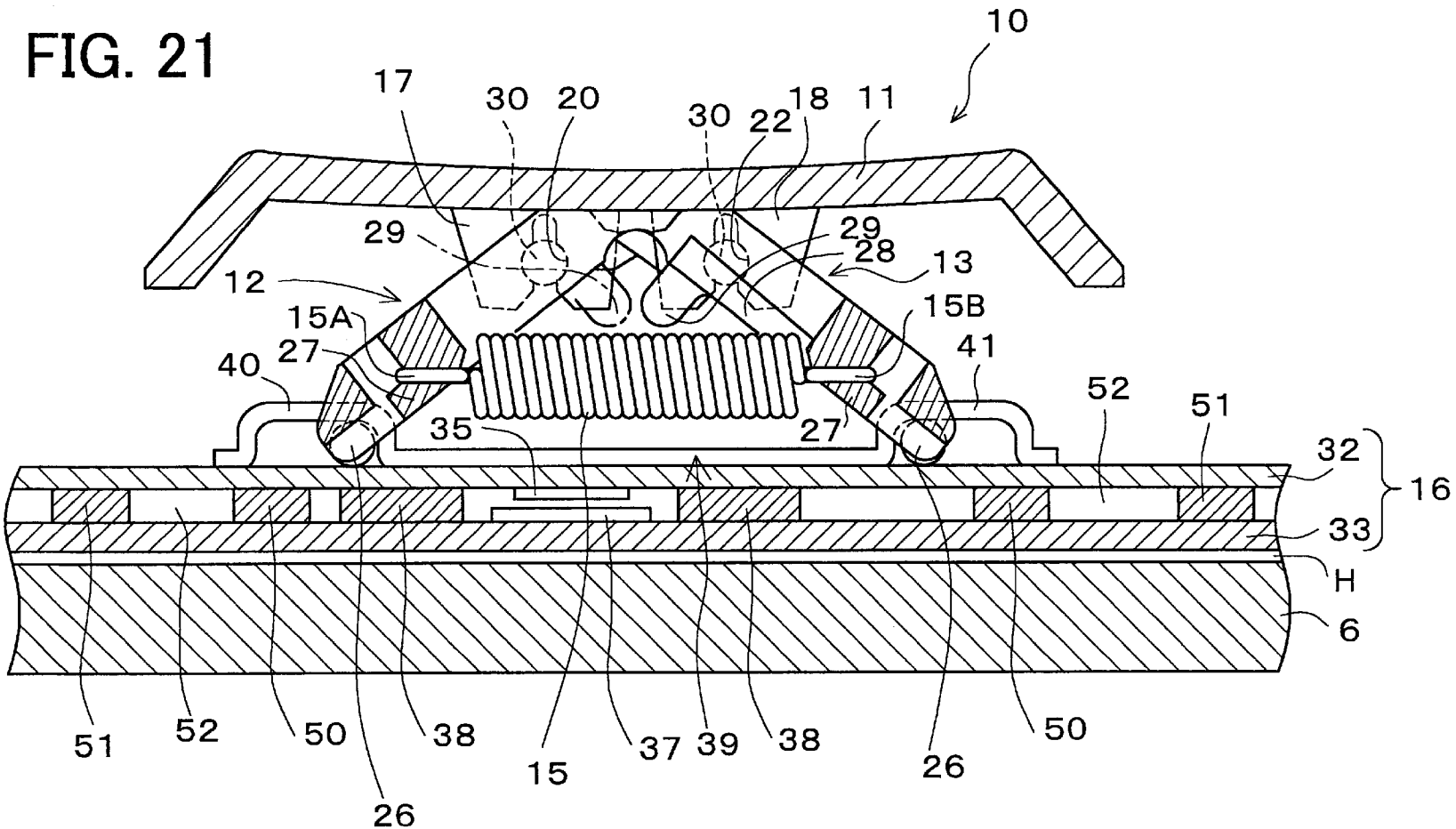
FIG. 21 is a sectional view of the key switch device in a non-depression state in the fourth embodiment.
Figure 22:
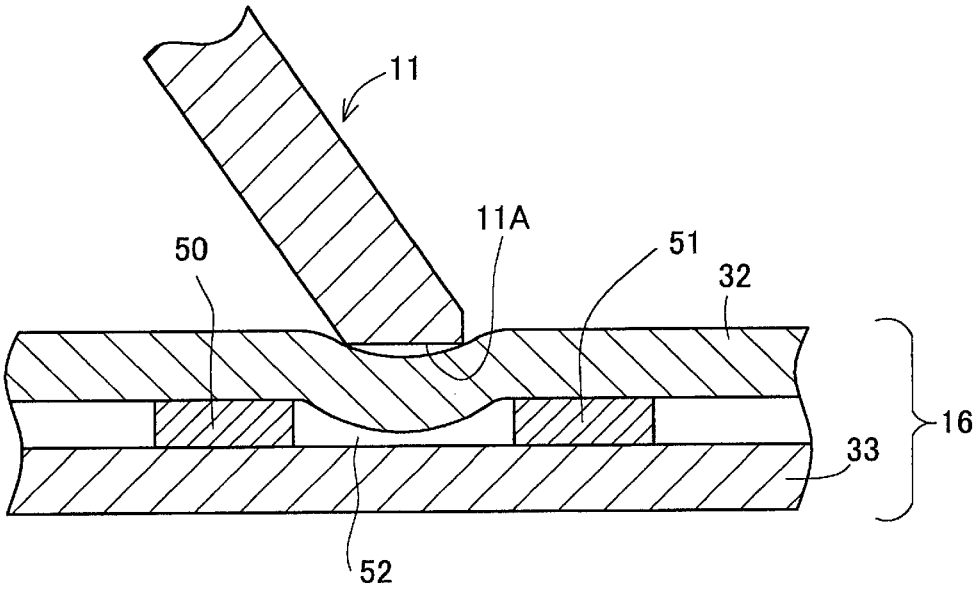
FIG. 22 is a partial sectional view of the upper switching sheet in a state where a lower end of the key top in depression pushes the sheet.
Figure 23:
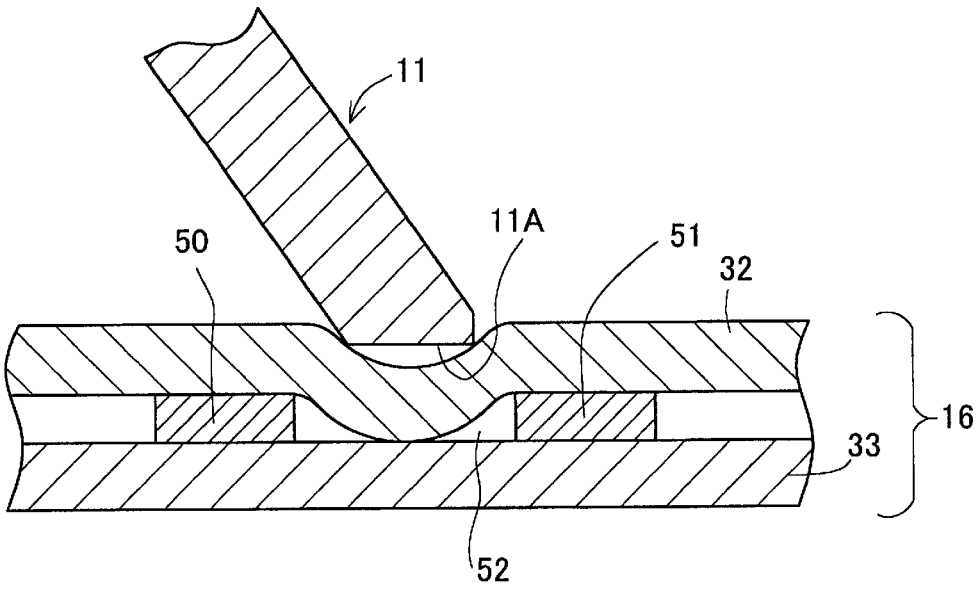
FIG. 23 is a partial sectional view of the upper switching sheet in another state where the lower end of the key top completely depressed pushes the sheet.
Figure 24:
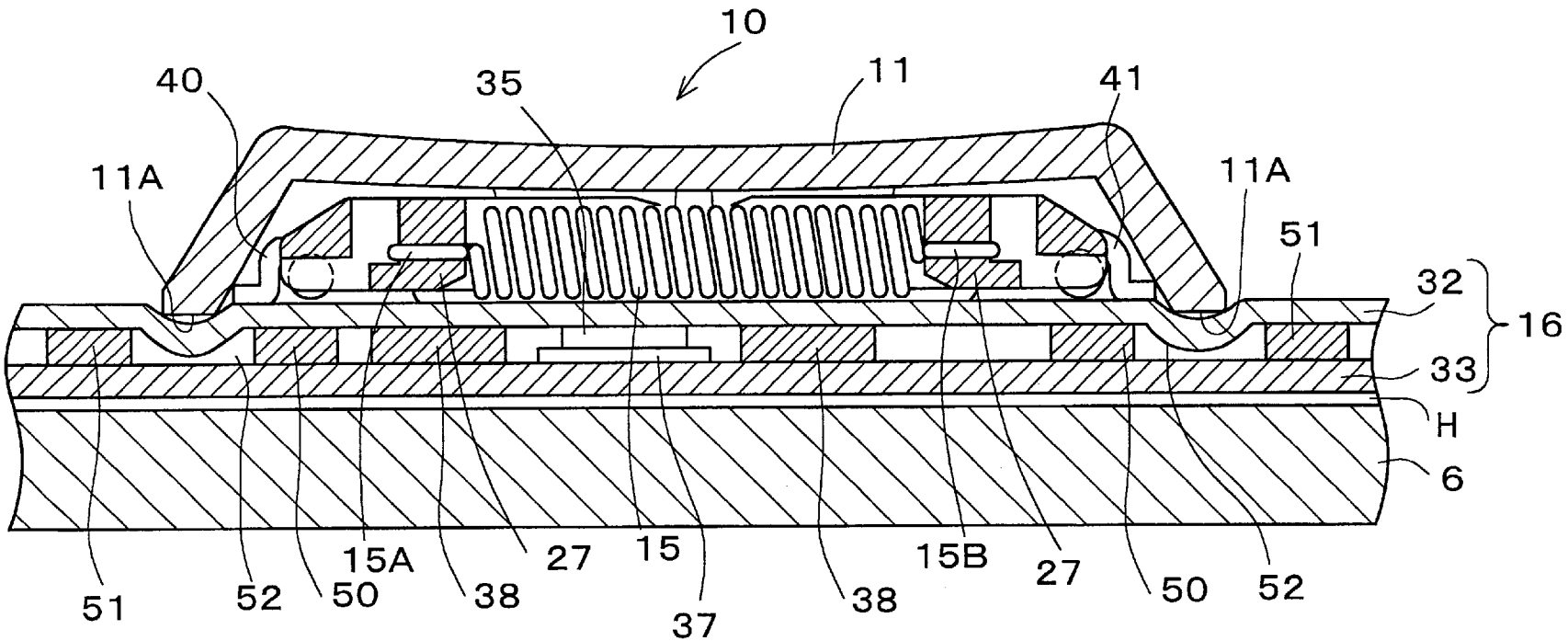
FIG. 24 is a sectional view of the key switch device with the key top completely depressed in the fourth embodiment.

Operation of the key top 10 constructed as above will be explained with reference to FIGS. 21–24. FIG. 21 is a sectional view of the key switch device 10 in a non-depression state. FIG. 22 is a partial sectional view of the upper switching sheet 32 in a state where the lower end 11A of the key top 11 in depression is pushing the sheet 32. FIG. 23 is a partial sectional view of the upper switching sheet 32 in a state where the lower end 11A of the key top 11 completely depressed pushes the sheet 32. FIG. 24 is a sectional view of the key switch device 10 with the key top 11 completely depressed.

As shown in FIG. 21, the coil spring 15 is disposed between the spring engagement portion 27 formed in the base portion 23 of the first link member 12 and the spring engagement portion 27 formed in the base portion 23 of the second link member 13. While the key top 11 is in the non-depression position, the coil spring 15 urges the first and second link members 12 and 13 to turn about each of the support shafts 30, as a rotation axis, rotatably supported in the corresponding bearing holes 20 and 22 provided on the underside of the key top 11, thereby bringing the lower ends of the link members closer to each other. In this state, the support shafts 26 of the first and second link members 12 and 13 are held in contact with the inner surfaces of the wall portions 40A and 41A of the third and fourth engagement portions 40 and 41 of the engagement member 39 fixed on the upper sheet 32 of the membrane switch sheet 16. The key top 11 is thus held in the non-depression position as shown in FIG. 21.

When the key top 11 is depressed from the position shown in FIG. 21 against the urging force of the coil spring 15, the support shafts 30 of the first linkmember 12 are rotated clockwise in the bearing holes 20 of the first engagement portions 17, while the support shafts 30 of the second link member 13 are rotated counterclockwise in the bearing holes 22 of the second engagement portions 18. The support shafts 26 of the first link member 12 are slid leftwards in the slide grooves 40D of the third engagement portions 40 of the engagement members 39 arranged in parallel. The support shafts 26 of the second link member 13 are slid rightwards in the slide grooves 41D of the fourth engagement portions 41 of the engagement members 39. In association with the above movement of the link members 12 and 13, the coil spring 15 is gradually stretched while allowing the lower ends of the first and second link members 12 and 13 to move away from each other.

The two tooth portions of the gear portions 31 of the arms 24 of the first link member 12 and the two tooth portions of the gear portions 31 of the arms 24 of the second link member 13 are lowered as held in contact relation when the key top 11 is depressed. In this way, the first and second link members 12 and 13 are operated in complete synchronization with each other by the cooperative action of the tooth portions of the gear portions 31.

When the key top 11 is pushed down by a predetermined amount, the pressing projections 29 of the elastic pieces 28 of the first and second link members 12 and 13 press from above the movable electrode 35 provided on the underside of the upper sheet 32 of the membrane switch sheet 16. When the key top 11 is further depressed, the pressing projections 29 click and bring the movable electrode 35 into contact with the fixed electrode 37 of the lower switching sheet 33 as shown in FIG. 24. A specified switching operation is thus effected between the electrodes 35 and 37.

Even after the above switching operation, the key top 11 may further go down according to the pressing force of a user. This further downward movement of the key top 11 after the switching operation causes the lower end 11A to come into contact with the upper sheet 32 of the membrane switch sheet 16, then pressing the sheet 32 as shown in FIG. 22. In the present embodiment, there is provided the rectangular area S with the interval D between the inner phantom rectangle defined by dot spacer pads 55 and the outer phantom rectangle defined by the spacer pads 56. The area S has an annular rectangular shape corresponding to the lower end 11A of the key top 11 and a larger width than the width d of the lower end 11A. Accordingly, in the area S, the space 52 is provided by the dot spacer pads 55 and 56.between the lower face of the upper sheet 32 and the upper face of the lower sheet 33.

Even when the lower end 11A of the key top 11 when depressed bumps on the upper sheet 32 of the membrane switch sheet 16, the above structure with the space 52 allows the alleviation of the impact of the key top 11 against the upper sheet 32. Such the impact alleviating effect by the space 52 can muffle or attenuate sound caused by the impact of the lower end 11A of the key top 11 against the upper sheet 32.

As shown in FIG. 23, even if the key top 11 is further depressed by the pressing force of the user, the downward movement of the key top 11 is absorbed slowly through the space 52 presenting the impact alleviating effect, thereby preventing the generation of sound by the impact.

When the depression force applied to the key top 11 is released after completion of the switching operation, the reverse operation to the above is performed by the urging force of the coil spring 15. The key top 11 is thus moved up to the non-depression position shown in FIG. 21.

It is to be noted that the present invention is not limited to the above embodiment and may be embodied in other specific forms without departing from the essential characteristics thereof. For instance, in the key switch device 10 in the above embodiment, the coil spring 15 is disposed between the first and second link members 12 and 13 to urge them in the closing direction, thereby to stably hold the key top 11 in the non-depression position. Alternatively, instead of the coil spring 15, the first and second link members may be provided with cam portions each having an elastic member for urging the cam portion toward the other one to thereby hold the key top 11 in the non-depression state.

Figure 25:
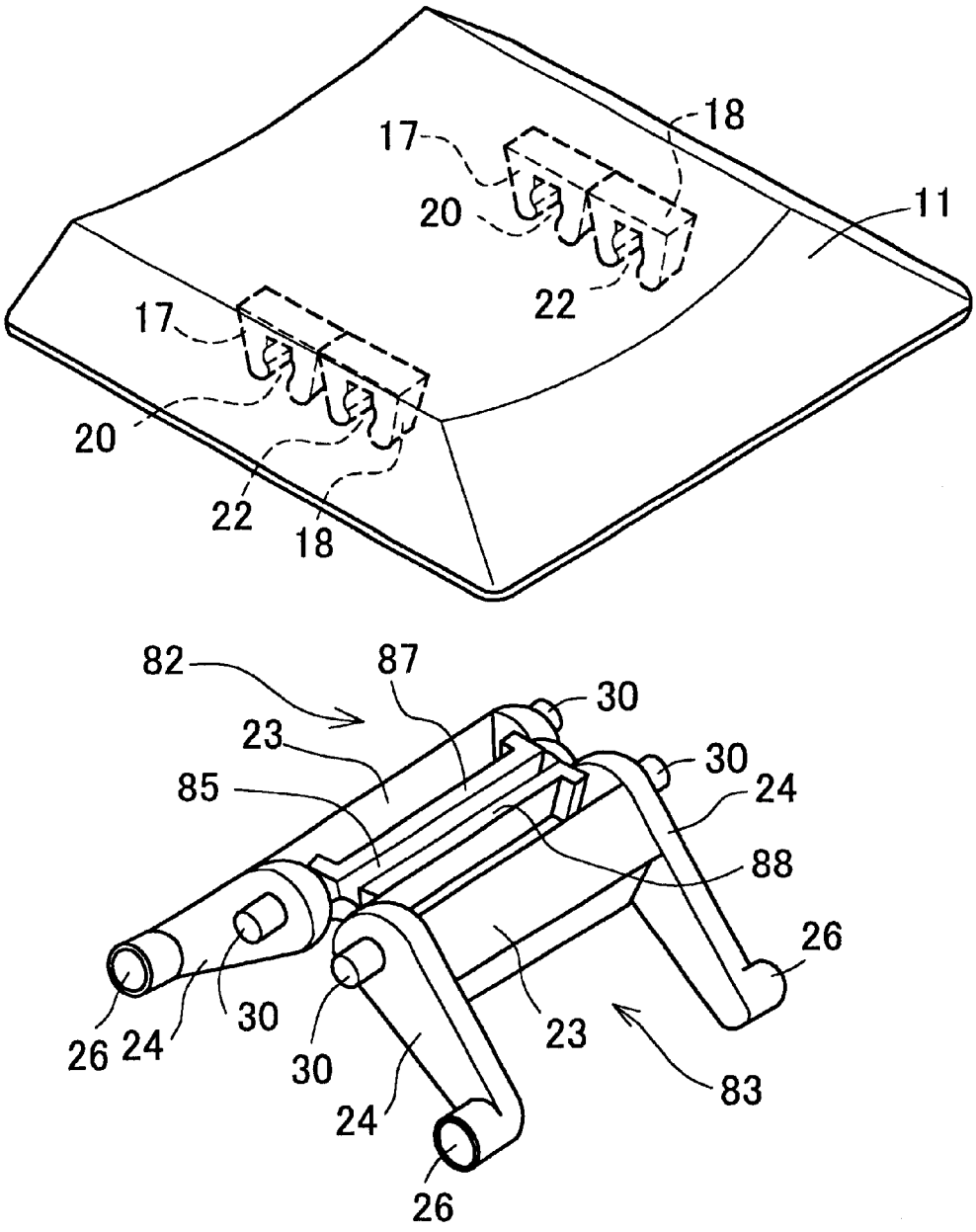
FIG. 25 is an exploded perspective view of a key switch device in a modified example in relation to the fourth embodiment.
Figure 26:
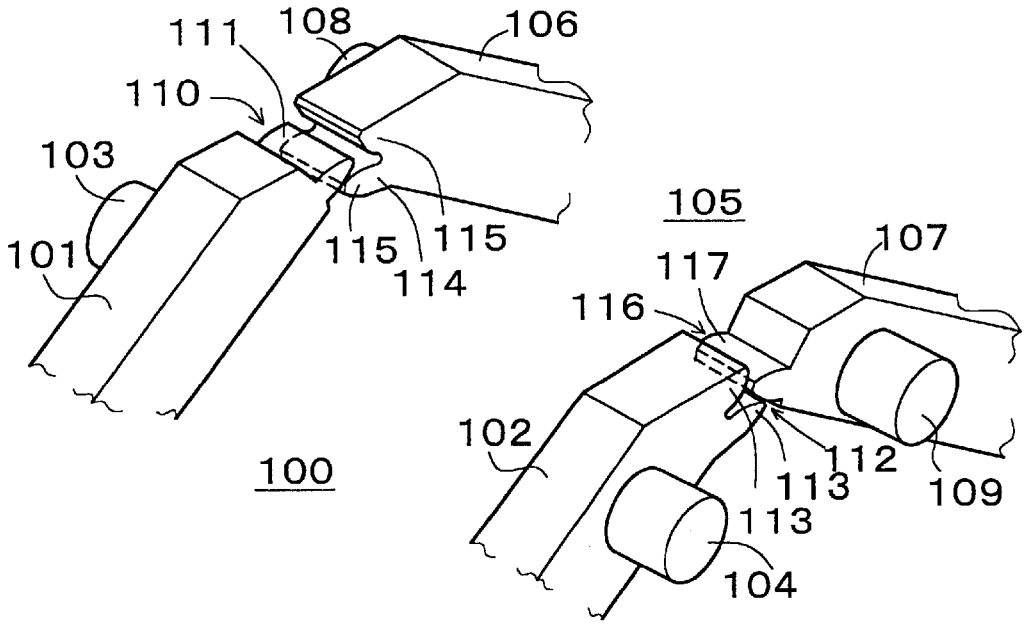
FIG. 26 PRIOR ART
FIG. 26 is a perspective partial enlarged view of gear portions of gear link members in a conventional key switch device.

A concrete configuration thereof is shown in FIG. 25. A first cam portion 85 of a first link member 82 and a second cam portion (not shown) of a second link member 83 are each formed with a first cam surface (not shown), a cam apex (not shown), and a second cam surface (not shown). A plate spring 87 is integrally formed with the first cam portion 85. Likewise, a plate spring 88 is integrally formed with the second cam portion. During non-depression of the key top 11, both the first cam surfaces of the first cam portion 85 and the second cam portion are held in contact with each other through the urging force of the plate springs 87 and 88, stably holding the key top 11 in the non-depression position. Upon depression of the key top 11, both the second cam surfaces of the first cam portion 85 and the second cam portion are brought in contact with each other through the urging force of the plate springs 87 and 88 while maintaining the upward turning moment of the first and second link members 82 and 83, and a switching operation is effected by an elastic resinous piece (not shown).

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto.

What is claimed is:

1. A key switch device including:

a key top provided at its underside with a first engagement portion and a second engagement portion;

a third engagement portion in correspondence with the first engagement portion, and a fourth engagement portion in correspondence with the second engagement portion, both of which are arranged below the key top;

a guide member for supporting the key top to guide vertical movement of the key top, the guide member including a first link member provided with a first shaft movably engaged in the first engagement portion and a third shaft movably engaged in the third engagement portion and a second link member provided with a second shaft movably engaged in the second engagement portion and a fourth shaft movably engaged in the fourth engagement portion;

a first gear portion provided near the first shaft in the first link member;

a second gear portion provided near the second shaft in the second link member; and a switching section for performing a switching operation in accordance with the vertical movement of the key top;

the first and second link members being arranged such that, in association with the vertical movement of the key top, the first and second link members are operated in synchronization with each other through a mutual contact relationship between the first and second gear portions;

wherein the first gear portion is provided with a first upper tooth portion and a first lower tooth portion which are arranged in adjacent relation in a direction of width of the first link member and in upper-and-lower relation in a direction of thickness of the first link member, the second gear portion is provided with a second upper tooth portion and a second lower tooth portion which are arranged in adjacent relation in a direction of width of the second link member and in upper-and-lower relation in a direction of thickness of the second link member, and the first upper tooth portion and the second lower tooth portion, and, the first lower tooth portion and the second upper tooth portion, are allowed to move, while maintaining mutually overlapping contact relation, in association with the vertical movement of the key top.

2. The key switch device according to claim 1, wherein the first link member is provided with a pair of arms, and the first gear portion is provided in a tip end of each of the arms, and the second link member is provided with a pair of arms, and the second gear portion is provided in a tip end of each of the arms.

3. The key switch device according to claim 1, wherein each of the first and second upper tooth portions is formed with a first curved surface which is curved upwards, and each of the first and second lower tooth portions is formed with a second curved surface which is curved downwards.

4. The key switch device according to claim 3 wherein the first and second curved surfaces are in close contact with each other during the vertical movement of the key top.

5. A keyboard provided with at least one key switch device according to claim 1.

6. The key switch device according to claim 1, wherein an engagement relationship between the third engagement portion and the third shaft of the first link member and that between the fourth engagement portion and the fourth shaft of the second link member are established easier to release than an engagement relationship between the first engagement portion of the key top and the first shaft of the first link member and that between the second engagement portion of the key top and the second shaft of the second link member.

7. The key switch device according to claim 6 further including:

a first shaft support portion elastically deformable, provided at a lower portion of the first link member; and a second shaft support portion elastically deformable, provided at a lower portion of the second link member;

the third shaft being provided in the first shaft support portion and the fourth shaft being provided in the second shaft support portion.

8. The key switch device according to claim 7, wherein the switching member includes a circuit board provided with a movable switch electrode and a fixed switch electrode, the third and fourth engagement portions are constructed from an engagement member formed with a pair of longitudinal groove-shaped engagement portions and fixed on the circuit board, and the third and fourth shafts are engaged in the corresponding longitudinal groove-shaped engagement portions of the engagement member.

9. The key switch device according to claim 8, wherein the engagement portions of the engagement member each include a portion formed in a round shape in section, with which the third and fourth shafts are brought into contact.

10. The key switch device according to claim 8, wherein the engagement member is produced by molding a linear material having a substantially circular shape in section into a predetermined shape and then cutting it into chips each having a unit length of the key switch device.

11. The key switch device according to claim 8, wherein the circuit board is constructed of an upper sheet provided with the movable switch electrode disposed on an underside, a lower sheet provided with the fixed switch electrode disposed facing the movable switch electrode, and a spacer body disposed between the upper and lower sheets to hold the movable switch electrode and the fixed switch electrode at a distance from each other, and the spacer body is constructed to provide a space between the upper and lower sheets in an area having a shape corresponding to a lower end of the key top and a width larger than a width of the lower end of the key top.

12. The key switch device according to claim 11, wherein the spacer body is constructed of a dot spacer provided on the upper or lower sheet, the dot spacer being formed to form the area.

13. An electronic apparatus including:

a keyboard for inputting various data such as characters, symbols, and others, the keyboard being provided with a key switch device including:

a key top provided at its underside with a first engagement portion and a second engagement portion;

a third engagement portion arranged below the key top in correspondence with the first engagement portion and, a fourth engagement portion arranged below the key top in correspondence with the second engagement portion;

a guide member for supporting the key top to guide vertical movement of the key top, the guide member including a first link member provided with a first shaft movably engaged in the first engagement portion and a third shaft movably engaged in the third engagement portion and a second link member provided with a second shaft movably engaged in the second engagement portion and a fourth shaft movably engaged in the fourth engagement portion;

a first gear portion provided near the first shaft in the first link member;

a second gear portion provided near the second shaft in the second link member; and a switching section for performing a switching operation in accordance with the vertical movement of the key top;

the first and second link members being arranged such that, in association with the vertical movement of the key top, the first and second link members are operated in synchronization with each other through a mutual contact relationship between the first and second gear portions;

wherein the first gear portion is provided with a first upper tooth portion and a first lower tooth portion which are arranged in adjacent relation in a direction of width of the first link member and in upper-and-lower relation in a direction of thickness of the first link member, the second gear portion is provided with a second upper tooth portion and a second lower tooth portion which are arranged in adjacent relation in a direction of width of the second link member and in upper-and-lower relation in a direction of thickness of the second link member, and the first upper tooth portion and the second lower tooth portion, and, the first lower tooth portion and the second upper tooth portion, are allowed to move, while maintaining mutually overlapping contact relation, in association with the vertical movement of the key top;

display means for displaying the characters, symbols, and others; and control means for controlling the display means to display the characters, symbols, and others based on input data from the keyboard.

14. A key switch device including:

a key top provided at its underside with a first engagement portion and a second engagement portion;

a third engagement portion arranged below the key top in correspondence with the first engagement portion, and a fourth engagement portion arranged below the key top in correspondence with the second engagement portion;

a guide member for supporting the key top to guide vertical movement of the key top, the guide member including a first link member provided with a first shaft movably engaged in the first engagement portion and a third shaft movably engaged in the third engagement portion and a second link member provided with a second shaft movably engaged in the second engagement portion and a fourth shaft movably engaged in the fourth engagement portion;

a first gear portion provided near the first shaft in the first link member;

a second gear portion provided near the second shaft in the second link member; and a switching section for performing a switching operation in accordance with the vertical movement of the key top;

the first and second link members being arranged such that, in association with the vertical movement of the key top, the first and second link members are operated in synchronization with each other through a mutual contact relationship between the first and second gear portions;

wherein the first gear portion is formed into a first single tooth with a contact surface, the second gear portion is formed into a second single tooth with a contact surface, and the first single tooth and the second single tooth are allowed to move, while maintaining mutually overlapping contact relation so that the contact surface of the first single tooth and the contact surface of the second single tooth usually contact during the vertical movement of the key top.

15. The key switch device according to claim 14, wherein one of the contact surfaces is curved upwards, while the other is curved downwards, and both the curved contact surfaces are in close contact with each other during the vertical movement of the key top.

16. A keyboard provided with at least one key switch device according to claim 14.

17. A key switch device including:

a key top provided at its underside with a first engagement portion and a second engagement portion;

a third engagement portion arranged below the key top in correspondence with the first engagement portion, and a fourth engagement portion arranged below the key top in correspondence with the second engagement portion;

a guide member for supporting the key top to guide vertical movement of the key top, the guide member including a first link member provided with a first shaft movably engaged in the first engagement portion and a third shaft movably engaged in the third engagement portion and a second link member provided with a second shaft movably engaged in the second engagement portion and a fourth shaft movably engaged in the fourth engagement portion;

a first and a second arms formed in the first link member, each of which is provided with the first shaft;

a third and a fourth arms formed in the second link member, each of which is provided with the second shaft;

the first link member being provided with a first gear portion formed near the first shaft of the first arm and a second gear portion formed near the first shaft of the second arm;

the second link member being provided with a second gear portion formed near the second shaft of the third arm and a first gear portion formed near the second shaft of the fourth arm;

a switching section for performing a switching operation in accordance with the vertical movement of the key top;

the first and second link members being arranged such that, in association with the vertical movement of the key top, the first and second link members are operated in synchronization with each other through a mutual contact relationship between the first gear portion of the first arm and the second gear portion of the third arm and through a mutual contact relationship between the second gear portion of the second arm and the first gear portion of the fourth arm;

wherein each of the first gear portions in the first arm of the first linkmember and the fourth arm of the second link member is provided with a first tooth portion;

each of the second gear portions in the second arm of the first link member and the third arm of the second link member is provided with a second tooth portion; and the first tooth portion of the first arm and the second tooth portion of the third arm, and, the second tooth portion of the second arm and the first tooth portion of the fourth arm, are allowed to move, while maintaining mutually overlapping contact relation, in association with the vertical movement of the key top.

18. An electronic apparatus including:

a keyboard for inputting various data such as characters, symbols, and others, the keyboard being provided with a key switch device including:

a key top provided at its underside with a first engagement portion and a second engagement portion;

a third engagement portion arranged below the key top in correspondence with the first engagement portion, and a fourth engagement portion arranged below the key top in correspondence with the second engagement portion;

a guide member for supporting the key top to guide vertical movement of the key top, the guide member including a first link member provided with a first shaft movably engaged in the first engagement portion and a third shaft movably engaged in the third engagement portion and a second link member provided with a second shaft movably engaged in the second engagement portion and a fourth shaft movably engaged in the fourth engagement portion;

a first gear portion provided near the first shaft in the first link member;

a second gear portion provided near the second shaft in the second link member and in contact with the first gear portion; and a switching section for performing a switching operation in accordance with the vertical movement of the key top;

the first and second link members being arranged such that, in association with the vertical movement of the key top, the first and second link members are operated in synchronization with each other through a mutual contact relationship between the first and second gear portions, wherein the first gear portion is formed into a first single tooth with a contact surface, and the second gear portion is formed into a second single tooth with a contact surface, and the first single tooth and the second single tooth are allowed to move, while maintaining mutually overlapping contact relation so that the contact surface of the first single tooth and the contact surface of the second single tooth usually contact during the vertical movement of the key top;

display means for displaying the characters, symbols, and others; and control means for controlling the display means to display the characters, symbols, and others based on input data from the keyboard.

19. A key switch device including:

two upper engagement portions provided extending downward from an underside of a key top;

two lower engagement portions arranged below the key top in correspondence with the upper engagement portions respectively;

a guide member for supporting the key top to guide vertical movement thereof, the guide member including a first link member provided with a first engagement member engaged in one of the upper engagement portions and a third engagement member engaged in one of the lower engagement portions and a second link member provided with a second engagement member engaged in the other upper engagement portion and a fourth engagement member engaged in the other lower engagement portion;

a switching member for performing a switching operation in accordance with the vertical movement of the key top;

wherein the third engagement member of the first link member is slidably engaged in one of the lower engagement portions and the fourth engagement member of the second link member is slidably engaged in the other engagement portion, and motion restraining means for restraining horizontal motion of the key top in course of depression is disposed between one of the lower engagement portions and first link member and between the other lower engagement portion and the second link member.

20. The key switch device according to claim 19, wherein the motion restraining means includes a slide groove formed by a wall portion to which the third or fourth engagement member is brought into contact during non-depression of the key top and a sloped portion sloping from the wall portion, the slide groove being disposed in at least one of the lower engagement portions.

21. The key switch device according to claim 20, wherein the third or fourth engagement member is formed into a shaft member having an elliptic shape in side view so that the shaft member is slid in the slide groove along an inclined surface of the sloped portion in association with the vertical movement of the key top while turning a longitudinal axis of the elliptic shape into a horizontal situation or a vertical situation.

22. The key switch device according to claim 20, wherein the sloped portion slopes outwardly.

23. The key switch device according to claim 22, wherein the third or fourth engagement member is formed into a shaft member having an elliptic shape in side view so that the shaft member is slid in the slide groove along an inclined surface of the sloped portion in association with the vertical movement of the key top while turning a longitudinal axis of the elliptic shape into a horizontal situation.

24. The key switch device according to claim 19, wherein the motion restraining means including:

a shaft member formed extending from a side face of the first or second link members; and a wall member formed near at least one of the lower engagement portions, for guiding the shaft member in contact therewith when the third or fourth engagement member is slid in association with depression of the key top.

25. A keyboard provided with one or more key switch device according to claim 19.

26. An electronic apparatus including:

a keyboard for inputting various data such as characters, symbols, and others, the keyboard being provided with a key switch device including:

two upper engagement portions provided extending downward from an underside of a key top;

two lower engagement portions arranged below the key top in correspondence with the upper engagement portions respectively;

a guide member for supporting the key top to guide vertical movement thereof, the guide member including a first link member provided with a first engagement member engaged in one of the upper engagement portions and a third engagement member engaged in one of the lower engagement portions and a second link member provided with a second engagement member engaged in the other upper engagement portion and a fourth engagement member engaged in the other lower engagement portion;

a switching member for performing a switching operation in accordance with the vertical movement of the key top;

wherein the third engagement member of the first link member is slidably engaged in one of the lower engagement portions and the fourth engagement member of the second link member is slidably engaged in the other engagement portion, and motion restraining means for restraining horizontal motion of the key top in course of depression is disposed between one of the lower engagement portions and first link member and between the other lower engagement portion and the second link member;

display means for displaying the characters, symbols, and others; and control means for controlling the display means to display the characters, symbols, and others based on input data from the keyboard.

* * * * *